US012065888B2

(12) United States Patent
Cassidy et al.

(10) Patent No.: US 12,065,888 B2
(45) **Date of Patent: *Aug. 20, 2024**

(54) FIBER OPTIC WETMATE

(71) Applicant: Schlumberger Technology Corporation, Sugar Land, TX (US)

(72) Inventors: Christopher Cassidy, Pearland, TX (US); Christopher Shen, Richmond, TX (US); Valeria Erives, Houston, TX (US); Pete Bazan, Friendswood, TX (US); Nabil Batita, Houston, TX (US); Julia Huynh, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/468,822

(22) Filed: Sep. 18, 2023

(65) Prior Publication Data

US 2024/0191581 A1 Jun. 13, 2024

Related U.S. Application Data

(63) Continuation of application No. 18/253,305, filed as application No. PCT/US2021/059923 on Nov. 18, 2021.

(Continued)

(51) Int. Cl.

| | |
|---|---|
| ***E21B 17/02*** | (2006.01) |
| ***E21B 43/10*** | (2006.01) |
| ***E21B 47/12*** | (2012.01) |

(52) U.S. Cl.

CPC ..... *E21B 17/023* (2013.01); *E21B 43/10* (2013.01); *E21B 47/12* (2013.01)

(58) Field of Classification Search

CPC .... E21B 17/023; E21B 17/028; E21B 17/003; E21B 17/025

See application file for complete search history.

(56) References Cited

U.S. PATENT DOCUMENTS

| | | | |
|---|---|---|---|
| 4,039,208 | A | 8/1977 | Pernet |
| 4,570,707 | A | 2/1986 | Setterberg, Jr. |

(Continued)

FOREIGN PATENT DOCUMENTS

| | | | |
|---|---|---|---|
| EP | 1212510 | A1 | 6/2002 |
| EP | 1251598 | A1 | 10/2002 |

(Continued)

OTHER PUBLICATIONS

"Control Line Wet Mate (CLWM) Connector", product sheet downloaded from [https://www.slb.com/-/media/files/co/product-sheet/control-line-wet-mate-ps.ashx] on Jun. 29, 2022, 2 pages.

(Continued)

*Primary Examiner* — David Carroll
(74) *Attorney, Agent, or Firm* — Philippe Laguerre

(57) ABSTRACT

Systems and methods are provided to facilitate connection of multiple stage completions. A first completion stage is deployed at a wellbore location. Subsequently, the next completion stage is moved downhole into engagement with the first completion stage. The completion stages each have communication lines that are coupled together downhole via a wetmate connection. Debris prevention and removal devices and methods are also provided.

10 Claims, 21 Drawing Sheets

Related U.S. Application Data

(60) Provisional application No. 63/192,635, filed on May 25, 2021, provisional application No. 63/192,249, filed on May 24, 2021, provisional application No. 63/115,079, filed on Nov. 18, 2020.

(56) References Cited

U.S. PATENT DOCUMENTS

| | | | | |
|---|---|---|---|---|
| 4,682,848 | A | 7/1987 | Cairns | |
| 5,197,546 | A | 3/1993 | Murray | |
| 5,577,925 | A | 11/1996 | Schnatzmeyer | |
| 5,838,857 | A | 11/1998 | Niekrasz | |
| 6,131,663 | A | 10/2000 | Henley | |
| 6,152,608 | A | 11/2000 | Ghara | |
| 6,186,229 | B1 | 2/2001 | Martin | |
| 6,349,767 | B2 | 2/2002 | Gissler | |
| 6,390,193 | B1 | 5/2002 | Martin | |
| 6,510,899 | B1 * | 1/2003 | Sheiretov | H01R 13/533 166/381 |
| 6,511,335 | B1 | 1/2003 | Rayssiguier | |
| 6,568,481 | B2 | 5/2003 | Koehler | |
| 6,571,046 | B1 | 5/2003 | Hickey | |
| 6,668,921 | B2 | 12/2003 | Koehler | |
| 6,776,636 | B1 | 8/2004 | Cameron | |
| 6,929,404 | B2 | 8/2005 | Jones | |
| 6,983,796 | B2 | 1/2006 | Bayne | |
| 7,165,892 | B2 | 1/2007 | Grigsby | |
| 7,191,832 | B2 | 3/2007 | Grigsby | |
| 7,228,898 | B2 | 6/2007 | Grigsby | |
| 7,252,437 | B2 | 8/2007 | Ringgenberg | |
| 7,398,822 | B2 | 7/2008 | Meijer | |
| 7,475,734 | B2 | 1/2009 | Edward | |
| 7,487,830 | B2 | 2/2009 | Wolters | |
| 7,503,395 | B2 | 3/2009 | Meijer et al. | |
| 7,509,000 | B2 | 3/2009 | Coronado | |
| 7,510,003 | B2 | 3/2009 | Meijer | |
| 7,556,093 | B2 | 7/2009 | Grigsby | |
| 7,594,763 | B2 | 9/2009 | Richards | |
| 7,607,477 | B2 | 10/2009 | Stoesz | |
| 7,611,290 | B2 | 11/2009 | Ringgenberg | |
| 7,628,543 | B2 | 12/2009 | Coronado | |
| 7,640,977 | B2 | 1/2010 | Jonas | |
| 7,644,755 | B2 | 1/2010 | Stoesz | |
| 7,736,067 | B2 | 6/2010 | Read | |
| 7,798,212 | B2 | 9/2010 | Bolze et al. | |
| 7,806,190 | B2 | 10/2010 | Du | |
| 7,900,698 | B2 | 3/2011 | Stoesz | |
| 8,061,429 | B2 | 11/2011 | Du | |
| 8,061,430 | B2 | 11/2011 | Du | |
| 8,082,990 | B2 | 12/2011 | Lovell | |
| 8,113,290 | B2 | 2/2012 | Sharma | |
| 8,496,064 | B2 | 7/2013 | Du | |
| 8,550,175 | B2 | 10/2013 | Shafiq | |
| 8,596,348 | B2 | 12/2013 | Brookbank | |
| 8,752,635 | B2 | 6/2014 | Wang | |
| 8,794,337 | B2 | 8/2014 | Thomas | |
| 8,839,850 | B2 | 9/2014 | Algeroy | |
| 8,936,078 | B2 | 1/2015 | Richards | |
| 9,157,561 | B2 | 10/2015 | Martin | |
| 9,270,051 | B1 | 2/2016 | Christiansen | |
| 9,404,314 | B2 | 8/2016 | Perez | |
| 9,523,243 | B2 | 12/2016 | Richards | |
| 9,627,798 | B2 | 4/2017 | Plant | |
| 9,683,412 | B2 | 6/2017 | Richards | |
| 9,759,016 | B2 | 9/2017 | Perez | |
| 9,850,720 | B2 | 12/2017 | Richards | |
| 9,915,104 | B2 | 3/2018 | Richards | |
| 9,945,203 | B2 | 4/2018 | Patel | |
| 9,988,894 | B1 | 6/2018 | Malone | |
| 10,000,995 | B2 | 6/2018 | Bishop | |
| 10,060,196 | B2 | 8/2018 | Richards | |
| 10,113,371 | B2 | 10/2018 | Richards | |
| 10,267,097 | B2 | 4/2019 | Mendez | |
| 10,329,855 | B2 | 6/2019 | Brady | |
| 10,329,871 | B2 | 6/2019 | King | |
| 10,352,110 | B2 | 7/2019 | Olin | |
| 10,502,003 | B2 | 12/2019 | Johnson | |
| 10,619,424 | B2 | 4/2020 | Loh | |
| 10,934,785 | B2 | 3/2021 | Fripp | |
| 11,162,306 | B2 | 11/2021 | Simonsen | |
| 11,193,339 | B2 | 12/2021 | El Mallawany | |
| 11,646,526 | B2 * | 5/2023 | Burrow | H01R 24/58 439/700 |
| 2003/0211768 | A1 | 11/2003 | Cameron | |
| 2005/0072564 | A1 | 4/2005 | Grigsby | |
| 2006/0086508 | A1 | 4/2006 | Coon | |
| 2006/0243450 | A1 * | 11/2006 | Head | E21B 43/128 166/381 |
| 2006/0243454 | A1 * | 11/2006 | Bolze | E21B 17/02 166/380 |
| 2006/0260803 | A1 | 11/2006 | Meijer et al. | |
| 2008/0029274 | A1 | 2/2008 | Rytlewski | |
| 2008/0223585 | A1 | 9/2008 | Patel | |
| 2009/0045146 | A1 * | 2/2009 | Stoesz | E21B 23/00 210/470 |
| 2009/0321069 | A1 * | 12/2009 | Jonas | E21B 17/046 166/242.6 |
| 2010/0314109 | A1 | 12/2010 | Garcia et al. | |
| 2011/0192596 | A1 | 8/2011 | Patel | |
| 2013/0048307 | A1 | 2/2013 | Patel | |
| 2013/0306316 | A1 | 11/2013 | Patel | |
| 2013/0319685 | A1 * | 12/2013 | Pike | E21B 17/023 166/66.5 |
| 2013/0327546 | A1 | 12/2013 | Rytlewski | |
| 2014/0352793 | A1 * | 12/2014 | Martin | F16L 37/35 137/14 |
| 2015/0368983 | A1 * | 12/2015 | Perez | E21B 17/028 166/378 |
| 2016/0006161 | A1 | 1/2016 | Ranalli | |
| 2016/0273290 | A1 | 9/2016 | Harms | |
| 2016/0356095 | A1 * | 12/2016 | Perez | E21B 17/023 |
| 2017/0357051 | A1 | 12/2017 | Bulu | |
| 2020/0080398 | A1 | 3/2020 | Loh | |
| 2021/0032940 | A1 | 2/2021 | Simonsen | |

FOREIGN PATENT DOCUMENTS

| | | | |
|---|---|---|---|
| GC | 2881 | A | 9/2014 |
| WO | 2004079151 | A2 | 9/2004 |
| WO | 2014089132 | A1 | 6/2014 |
| WO | 2015060817 | A1 | 4/2015 |
| WO | 2015044208 | A3 | 6/2015 |
| WO | 2017105434 | A1 | 6/2017 |
| WO | 2017213726 | A2 | 12/2017 |
| WO | 2020087001 | A1 | 4/2020 |
| WO | 2021247726 | A1 | 12/2021 |
| WO | 2022109157 | A1 | 5/2022 |
| WO | 2022192669 | A1 | 9/2022 |
| WO | 2022216933 | A1 | 10/2022 |

OTHER PUBLICATIONS

"HLWM Hydraulic-line downhole wet-mate connector", product sheet downloaded from [https://www.slb.com/-/media/files/co/product-sheet/hlwm-ps.ashx] downloaded on Jun. 29, 2022, 2 pages.

"HEWM Hydraulic and electric downhole wet-mate connector" product sheet downloaded from [https://www.slb.com/-/media/files/co/product-sheet/hewm-ps.ashx] downloaded on Jun. 29, 2022, 2 pages.

B.K. Drakeley et al., 2014, "Integration into the Sandface Tool System for Gravel and Frack-Pack Installations with a Fiber Optics Wet-Mate Connector System", OTC-25195-MS, Offshore Technology Conference, held in Houston, Texas, USA, May 5-8, 2014 (15 pages).

International Search Report and Written Opinion of International Patent Application No. PCT/US2022/019952 dated Jun. 20, 2022, 10 pages.

International Search Report and Written Opinion of International Patent Application No. PCT/US2022/023838 dated Jul. 26, 2022, 12 pages.

(56) References Cited

OTHER PUBLICATIONS

"SureCONNECT Downhole Intelligent Wet-Mate System", downloaded on May 21, 2023 from link https://www.bakerhughes.com/completions/well-monitoring-and-analytics/sureconnect-downhole-intelligent-wetmate-system (8 pages).
"QUANTUM Snap Latch Assembly", (2014) SLB product sheet, downloaded on May 21, 2023, from link https://www.bing.com/searchq=QUANTUM+Snap+Latch+Assembly search= pc=U522 form=CHRDEF, (1 page).
"QUANTUM Anchor Latch Assembly", (2014) SLB product sheet, downloaded on May 21, 2023 from link https://www.bing.com/searchq=QUANTUM+Anchor+Latch+Assembly qs=n form=QBRE sp =- 1 ghc=1 lq=0 pq=quantum+anchor+latch+assembly sc=6-29 sk= cvid=C6BC1C74AC8C44EC9D227795D68F1DD9 ghsh=0 ghacc=0 ghpl= (1 page).
"QUANTUM Shear-Type Anchor Latch" (2014), SLB product sheet, downloaded on May 21, 2023, from link https://www.bing.com/searchq=QUANTUM+Shear-Type+Anchor+Latch qs=n form=QBRE sp =- 1 ghc=1 lq=0 pq=quantum+shear-type+anchor+latch sc=6-31 sk= cvid=A2F41C06C6DB44198EEFF506C1CB5DFB ghsh=0 ghacc=0 ghpl= (1 page).
International Search Report and Written Opinion issued in the PCT Application PCT/US2021/035478, dated Nov. 12, 2021 (12 pages).
International Search Report and Written Opinion of International Patent Application No. PCT/US2021/059923 dated Mar. 11, 2022, 11 pages.

* cited by examiner

FIBER OPTIC WETMATE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. This application is a continuation of U.S. patent application Ser. No. 18/253,305, filed Nov. 18, 2021, which is a National Stage of International Application No. PCT/US2021/059923, filed Nov. 18, 2021, which claims priority benefit of U.S. Provisional Application Nos. 63/115,079, filed Nov. 18, 2020, 63/192,249, filed May 24, 2021, and 63/192,635, filed May 25, 2021, the entirety of each of which is incorporated by reference herein and should be considered part of this specification.

BACKGROUND

Field

The present disclosure generally relates to multi-stage completions and downhole connectors for use in oil and gas wells, and more particularly, to systems and methods for connecting multi-stage completions, for example, including, but not limited to, multi-stage completions including optical fibers.

Description of the Related Art

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

In many applications, it is desirable to instrument the lower completion with electrical or optical sensors or to provide for transmission of fluids to devices in the lower completion. For example, a fiber optic cable can be placed in the annulus between the screen and the open or cased hole. To enable communication of signals between the sensor in the lower completion and the surface or seabed, a wet-mate connection is needed between the upper and lower completion equipment.

SUMMARY

In some configurations, a downhole completion system includes an upper completion stage comprising a stinger and a first communication line connector; a lower completion stage comprising a receptacle and a second communication line connector, the stinger configured to engage the receptacle and the first communication line connector configured to couple to the second communication line connector; and a debris prevention architecture configured to protect the first and second communication line connectors from debris.

The debris prevention architecture can include a spring-loaded block configured to protect the second communication line connector from debris and damage. In use, as the stinger is moved into engagement with the receptacle, the stinger is configured to push the spring-loaded block downward to expose the second communication line connector.

The debris prevention architecture can include a flushing system configured to flush at least one of the first communication line connector and the second communication line connector with clean flushing fluid during both a mating operation of the first and second communication line connectors and a demating operation of the first and second communication line connectors, and wherein the flushing system is activated by sliding movement of the spring-loaded block to expose or cover the second communication line connector.

The lower completion stage can include one or more alignment keys. One of the alignment keys can include a spring latch configured to engage a latch key on the spring-loaded block to hold the spring-loaded block in a position covering the second communication line connector. As the stinger is moved into engagement with the receptacle, the stinger is configured to deflect the spring latch out of engagement with the latch key to allow the spring-loaded block to move downward and expose the second communication line connector.

The debris prevention architecture can include a rigid sleeve configured to protect the second communication line connector from debris and damage. The stinger can include a stinger connector port housing the first communication line connector, wherein in use as the stinger engages the receptacle, the rigid sleeve stabs into the stinger connector port. In some configurations, the system further includes a debris prevention device and/or a debris removal device disposed in the stinger connector port, wherein in use, the rigid sleeve is configured to puncture the debris prevention device and/or the debris removal device is configured to wipe an outside of the rigid sleeve. The rigid sleeve can form a receptacle connector port housing the second communication line connector, and the system can further include a debris prevention device and/or a debris removal device disposed in the receptacle connector port. In use, as the stinger engages the receptacle, the first communication line connector punctures the debris prevention device and/or the debris removal device wipes an outside of the first communication line connector.

The stinger can include a stinger connector port housing the first communication line connector. A debris prevention device and/or a debris removal device can be disposed in or at an entrance to the stinger connector port.

The debris prevention architecture can include one or more debris prevention devices and/or one or more debris removal devices. The debris prevention device and/or the debris removal device can include a grommet cover, the grommet cover having an end face comprising a plurality of slits forming a plurality of flaps, wherein in use, one of the first and second communication line connectors penetrates the end face, and the flaps wipe debris from the communication line connector. The grommet cover can have a cone shaped face. The debris prevention device and/or the debris removal device can include a split septum cover, the split septum cover having an end face comprising a slit, wherein in use, one of the first and second communication line connectors penetrates the end face. The debris prevention device and/or the debris removal device can include a split septum sleeve. The split septum sleeve can include an end face and a sleeve, which may be corrugated, the sleeve configured to compress in use to exposure the communication line connector. The debris prevention device and/or the debris removal device can include a debris wiper, the debris wiper comprising a central cavity and a plurality of find projecting into the central cavity, wherein in use, one of the first and second communication line connectors extends through the cavity and the fins wipe an outside of the connector. The debris wiper can be elastomeric. The debris prevention device and/or the debris removal device can include a coiled brush, the coiled brush comprising a plurality of bristles configured to wipe an outside of one of the first and second communication line connectors as the connector extends through the coiled brush in use.

The debris prevention architecture can include a debris exclusion door configured to protect the first communication line connector from debris and damage. The debris exclusion door can be biased to a closed position by a return spring, the closed position configured to cover a cavity housing the first communication line connector, and wherein the receptacle is configured to pivot the debris exclusion door to an open position. The lower completion stage can include one or more alignment keys configured to be received in one or more corresponding slots formed in the stinger, the one or more alignment keys configured to pivot the debris exclusion door to the open position. The debris prevention architecture can further include a membrane disposed behind the debris exclusion door, the membrane configured to be punctured by the second communication line connector.

In some configurations, the debris prevention architecture includes a flushing system configured to flush at least one of the first communication line connector and the second communication line connector with clean flushing fluid during both a mating operation of the first and second communication line connectors and a demating operation of the first and second communication line connectors. The flushing system can be configured to flush with clean flushing fluid during multiple mating and demating cycles. The flushing system can include: a first plunger; a first plunger chamber, the first plunger configured to move relatively into and out of the first plunger chamber; a second plunger; a second plunger chamber, the second plunger configured to move relatively into and out of the second plunger chamber; wherein during a mating operation of the first and second communication line connectors, movement of the first plunger relatively into the first plunger chamber releases a volume of fluid to flush the second communication line connector; and wherein during a demating operation of the first and second communication line connectors, movement of the second plunger relatively into the second plunger chamber releases a volume of fluid to flush the second communication line connector. During the mating operation, movement of the second plunger relatively out of the second plunger chamber refills the second plunger chamber and second plunger with fluid from a refill chamber, and during the demating operation, movement of the first plunger relatively out of the first plunger chamber refills the first plunger chamber and first plunger.

In some configurations, a method of forming a completion in a wellbore includes deploying a lower completion stage in a wellbore, the lower completion stage comprising a receptacle and a first communication line connector; deploying an upper completion stage in the wellbore, the upper completion stage comprising a stinger and a second communication line connector; while deploying the upper completion stage in the wellbore, using a first debris prevention architecture to protect the first communication line connector until coupled with the second communication line connector, and using a second debris prevention architecture to protect the second communication line connector from debris and/or damage; inserting the stinger in the receptacle; and coupling the first and second communication line connectors.

The second debris prevention architecture can include a debris exclusion door covering an opening to a port housing the second communication line connector, the method further comprising pivoting the debris exclusion door to an open position by contact with the lower completion stage. The first debris prevention architecture can include a spring-loaded sliding cover, the method further comprising sliding the spring-loaded sliding cover to expose the first communication line connector by contact with the stinger. The method can further include releasing a fluid to flush the first and/or second communication line connectors by sliding the spring-loaded sliding cover to expose the first communication line connector and by sliding the spring-loaded sliding cover to recover the first communication line connector.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
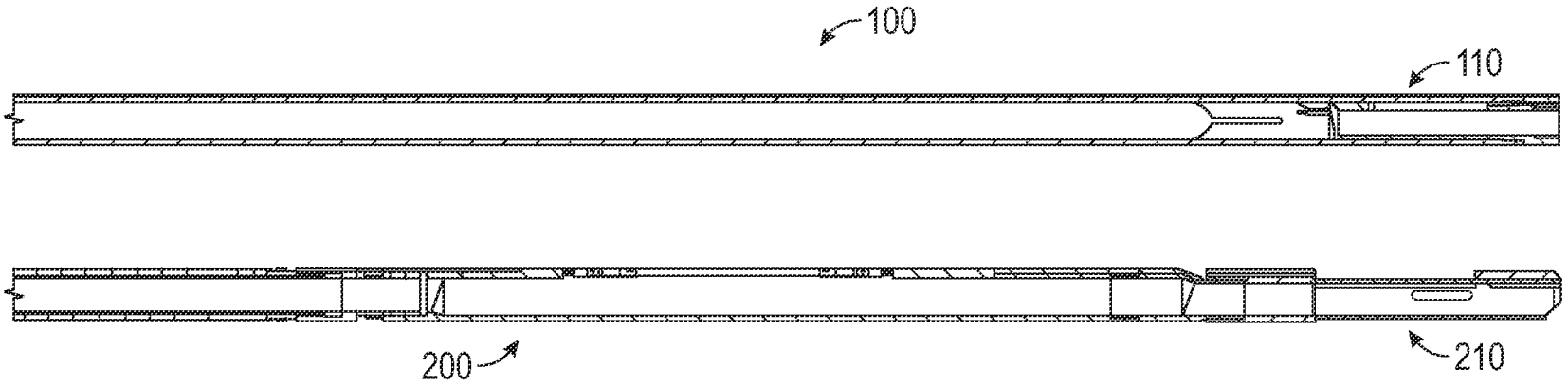
FIG. 1 illustrates an example two-stage completion.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Many types of wells, e.g., oil and gas wells, are completed in multiple stages. For example, a lower stage of the completion, or lower completion assembly, is moved downhole on a running string. After deployment of the lower completion assembly at a desired location in the wellbore, an upper stage of the completion, or upper completion assembly, is deployed downhole and engaged with the lower completion assembly.

Many well completions incorporate one or more control lines, such as optical, electrical, and/or hydraulic control lines, to carry signals to or from components of the downhole completion. For example, in many applications, it is desirable to instrument the lower completion with electrical or optical sensors or to provide for transmission of fluids to devices in the lower completion. To enable communication of signals between the sensor in the lower completion and the surface or seabed, a wet-mate connection is needed between the upper and lower completion equipment. The completion of wells in two or more stages, however, can create difficulties in forming dependable and repeatable control line connections between adjacent completion assemblies. For example, wet mate connectors tend to be susceptible to contamination by debris during the mating process and/or during the intervening time between installation of the lower completion and installation of the upper completion.

The present disclosure provides systems and methods for connecting an upper completion with a lower completion. More specifically, the present disclosure provides various systems and methods for debris prevention, mitigation, and/or management. As used herein, "lower" can refer to a first or lead equipment/assembly moved downhole. "Upper" can refer to a second or later equipment/assembly moved downhole into engagement with the lower unit. In a horizontal wellbore, for example, the lower equipment/assembly is run downhole first prior to the upper equipment/assembly. Such systems and methods allow for various types of connections and/or communication between the upper and lower completion, for example, control line communication and/or connection, fiber optic communication and/or connection, electrical connection and/or communication, etc.

Systems and methods according to the present disclosure can advantageously allow for monitoring, e.g. continuous real time monitoring, or temperature (or other data) along the entire length of the upper and lower completion, for example, using an optical fiber deployed or housed within a control line. Additionally or alternatively, systems and methods according to the present disclosure can advantageously allow for water injection and/or hydraulic communication to or with the lower completion. In some configurations, systems and methods according to the present disclosure advantageously allow for transmission of signals, e.g., electrical and/or hydraulic signals, to actuate various devices along the lower completion string, such as flow control devices and/or flow isolation valves. Additionally or alternatively, such signals, e.g., electrical and/or hydraulic signals, can be used to actuate setting sequence(s) for packer(s).

In some configurations, systems and methods according to the present disclosure allow for deploying and connecting a fiber optic sensor network in a two-stage completion. In some configurations, the present disclosure provides systems and methods for coupling control lines, such as hydraulic lines, of the upper and lower completions. Fiber can then be pumped from the surface, for example, with water or another fluid, through the entire length of the coupled control lines to reach the lower completion. In other configurations, an optical fiber can be pre-deployed. The lower completion can be run with fiber, then the upper completion can be run with fiber, and the fiber of the upper completion and fiber of the lower completion can be mated via a connector. This can advantageously save time during deployment and installation as the fiber does not need to be pumped from the surface once a wetmate connection has been established. Once the connection is established, a continuous optical path is established from a surface location to the bottom of an open hole formation and back to the surface location to complete an optical loop. In some configurations, systems and methods according to the present disclosure also or alternatively allow for connecting other types of control lines and/or connectors, such as electrical control lines or connectors or fluid control lines or connectors. Different types of control lines and/or connectors, including fiber optic, electrical, and/or hydraulic control lines and/or connections, can be included in various combinations. The connections may be established, broken, and reestablished repeatedly.

Connection systems and methods according to the present disclosure may be used for land applications, offshore platform applications, or subsea deployments in a variety of environments and with a variety of downhole components. The systems and methods can be used to connect a variety of downhole control lines, including communication lines, power lines, electrical lines, fiber optic lines, hydraulic conduits, fluid communication lines, and other control lines. The connections can allow for the deployment of sensors, e.g., fiber optic sensors, in sand control components, perforating components, formation fracturing components, flow control components, or other components used in various well operations including well drilling operations, completion operations, maintenance operations, and/or production operations.

The upper and lower completion assemblies can include a variety of components and assemblies for multistage well operations, including completion assemblies, drilling assemblies, well testing assemblies, well intervention assemblies, production assemblies, and other assemblies used in various well operations. The upper and lower assemblies can include a variety of components depending on the application, including tubing, casing, liner hangers, formation isolation valves, safety valves, other well flow/control valves, perforating and other formation fracturing tools, well sealing elements, e.g., packers, polish bore receptacles, sand control components, e.g., sand screens and gravel packing tools, artificial lift mechanisms, e.g., electric submersible pumps or other pumps/gas lift valves and related accessories, drilling tools, bottom hole assemblies, diverter tools, running tools and other downhole components.

FIG. 1 illustrates an example two-stage completion including an upper completion 200 and a lower completion 100. A stinger 210 is positioned at a bottom end of the upper completion 200. The lower completion 100 includes a receptacle 110. In the illustrated configuration, the receptacle 110 is positioned at the bottom of the lower completion 100. In use, the upper completion 200 is run inside the lower completion 100, and the stinger 210 engages the receptacle 110 to complete a downhole connection.

Figure 2:
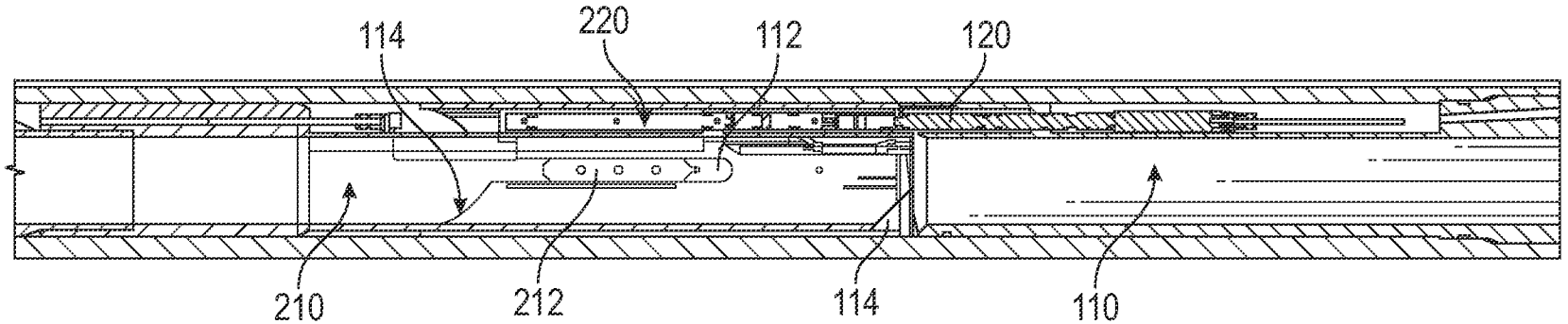
FIG. 2 illustrates an example downhole wetmate system.
Figure 3:
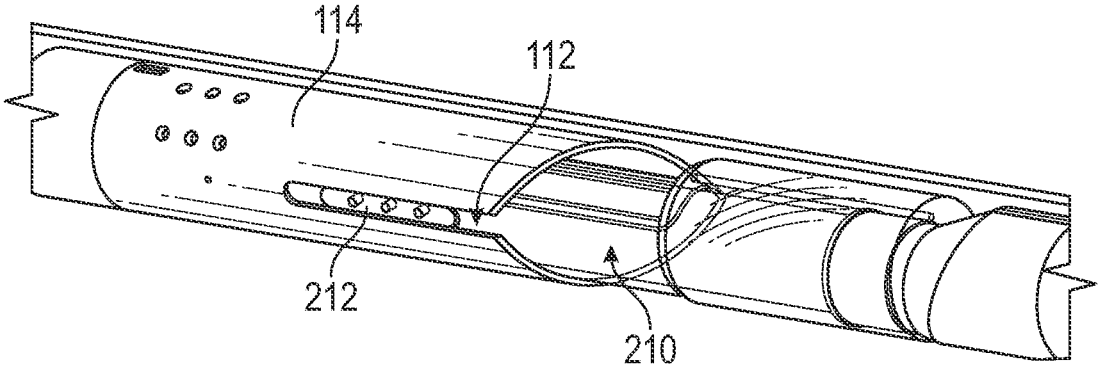
FIG. 3 illustrates engagement of a stinger and receptacle of the downhole wetmate system of FIG. 2.
Figure 4:
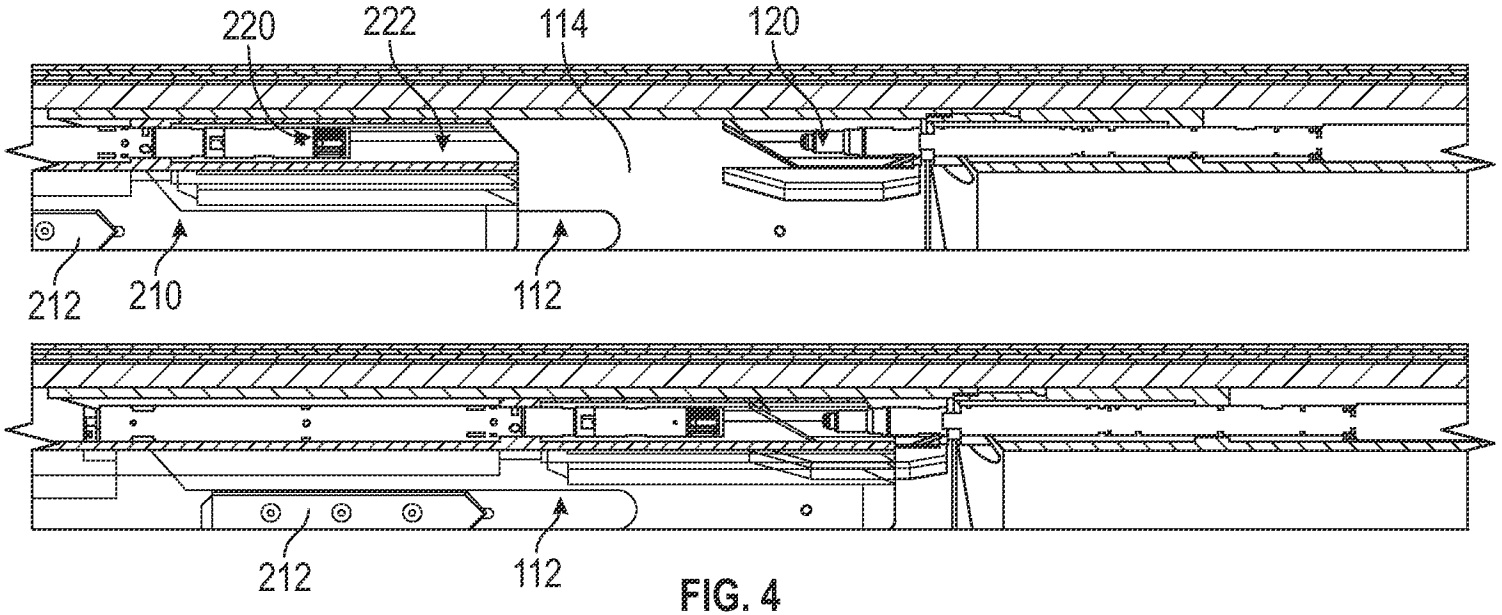
FIG. 4 illustrates coupling of the stinger with the receptacle of FIG. 3.

FIG. 2 shows an example downhole wetmate system, for example that can be included in a two-stage completion such as that shown in FIG. 1. The upper completion 200, for example, the stinger 210, can include one or more upper connectors 220. The lower completion 100, for example, the receptacle 110, can include one or more lower connectors 120. The upper 220 and lower 120 connectors can be of various types and allow for connections of various types, including fiber optic, electric, and/or hydraulic connectors and connections. In use, as the upper completion 200 is run in hole, the stinger 210 is lowered until a stinger key 212 on the stinger contacts or engages an alignment sleeve 114 of the receptacle 110. The alignment sleeve 114 has a generally helical or curved profile. The stinger key 212 rotates along the helix of the alignment sleeve 114 until the stinger key 212 is clocked or aligned with a slot 112 in the alignment sleeve 114. The upper completion 200 is then further lowered as the stinger key 212 moves into and along the slot 112 until the stinger 210 fully engages the receptacle 110, as shown in FIGS. 3-4. The upper connectors are then mated with the lower connectors, as shown in FIG. 2.

FIG. 5, FIG. 6, FIG. 7, FIG. 8A, FIG. 8B, and FIG. 8C illustrate various debris prevention, mitigation, management, and/or removal concepts according to the present disclosure. These concepts can advantageously include few mobile components. As mobile components can themselves be prone to debris risks, a design including fewer mobile components can help increase the overall reliability of the downhole wetmate system. Various debris prevention or mitigation features according to the present disclosure can be used to protect hydraulic, electrical, and/or fiber optic connectors. Various debris prevention or mitigation features, for example as described herein, can be located on the upper completion 200, e.g., the stinger 210, and/or the lower completion 100, e.g., the receptacle 110.

Figure 5:
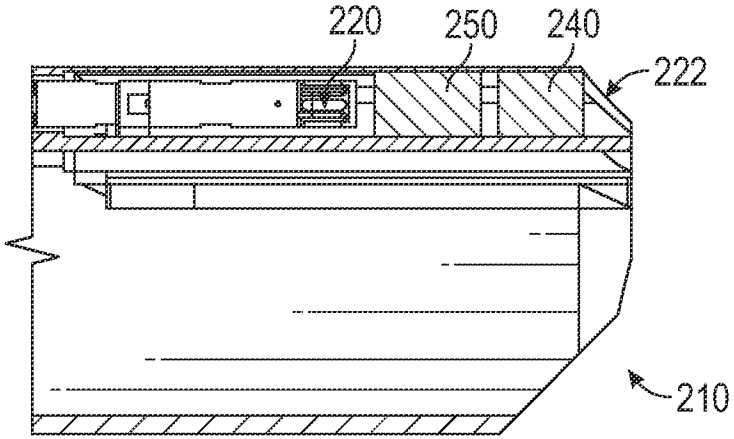
FIG. 5 illustrates an example debris prevention architecture for a downhole wetmate system.
Figure 6:
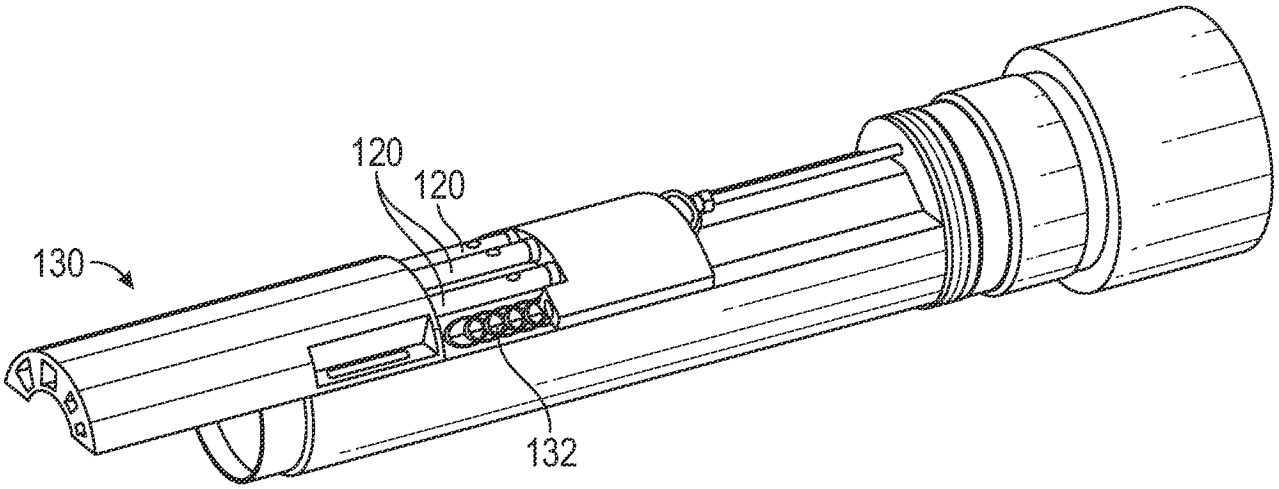
FIG. 6 illustrates another example debris prevention architecture for a downhole wetmate system.
Figure 7:
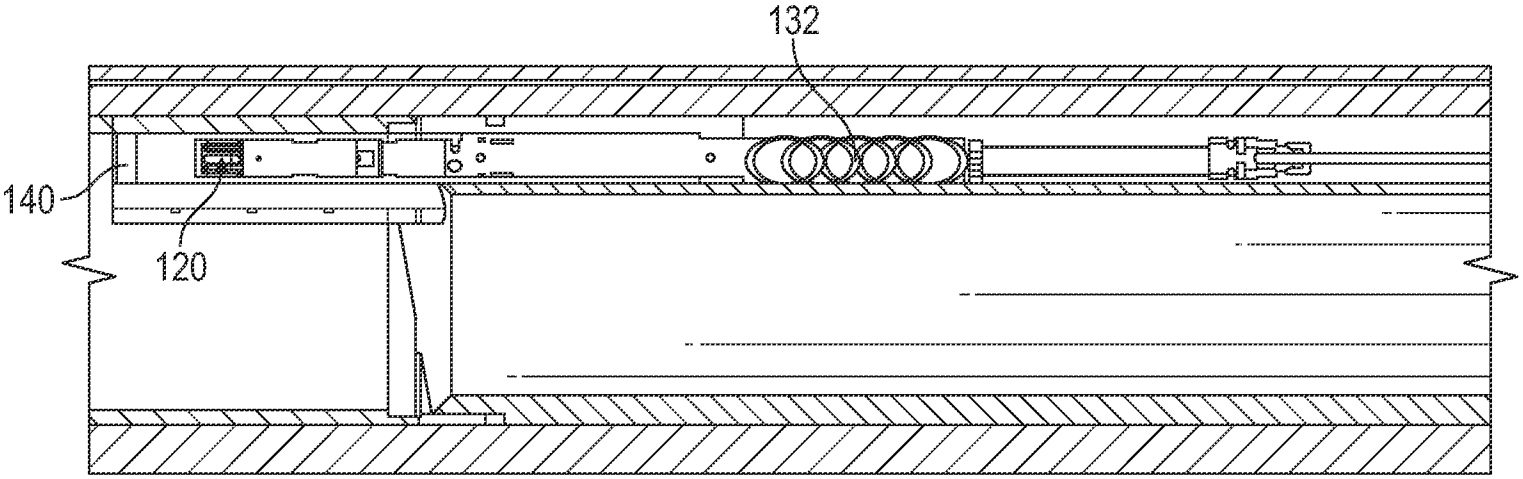
FIG. 7 illustrates yet another an example debris prevention architecture for a downhole wetmate system.

FIGS. 5-7 illustrate a debris prevention architecture that includes a single mobile debris exclusion member on the receptacle 110 in the lower completion 100. The stinger 210 has no internal moving components. The receptacle 110 incudes a spring 132 loaded block 130 that protects the lower connector(s) 120 from debris and damage. The block 130 is pushed downward due to contact with the mating stinger 210 to expose the connector(s) 120. The connector(s) 120 then stab into the stinger port 222 to establish a connection with the upper connector(s) 220.

In some configurations, the stinger 210 includes a stationary debris prevention device 240 and/or a stationary debris removal device 250 installed in the connector pocket(s) or stinger port 222. The debris prevention device 240 can help keep debris away from the upper connector(s) 220 during run in hole. The debris removal device 250 can help clean debris away from the lower connector(s) 120 as they stab into the stinger port(s) 222 before the connection is made. The spring loaded block 130 can include a debris protector or debris prevention device 140, for example at or on an upper end of the block 130, as shown in FIG. 7.

Figure 8A:
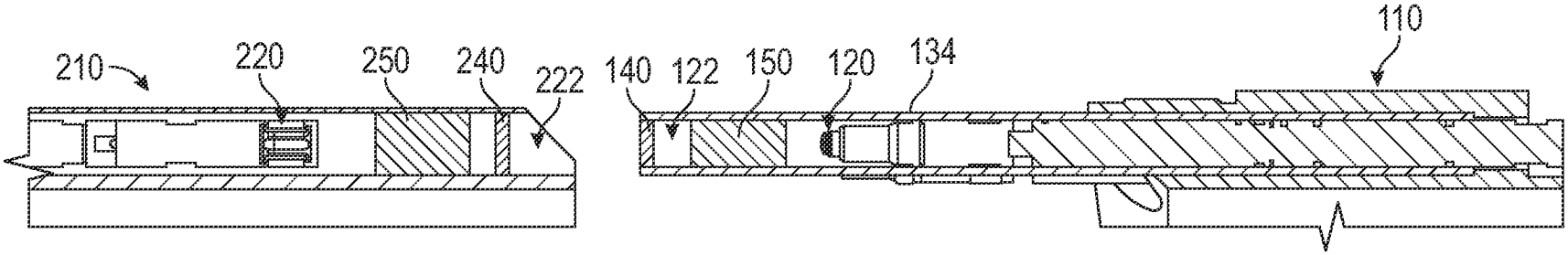
FIGS. 8A, 8B, and 8C illustrates another example debris prevention architecture for a downhole wetmate system.
Figure 8B:
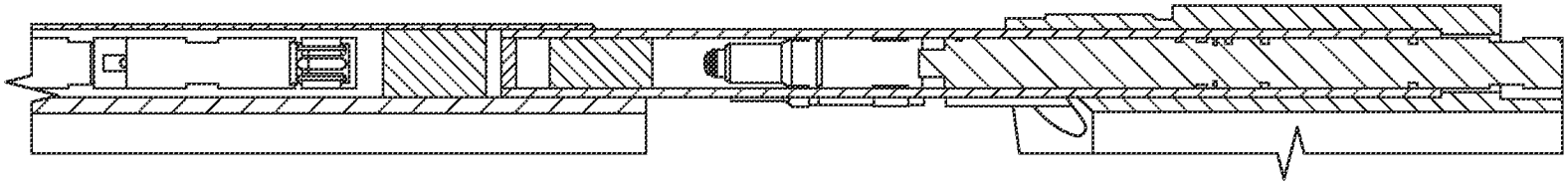
Figure 8C:
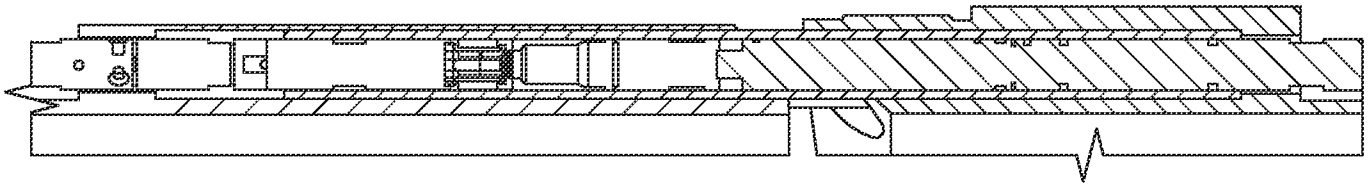

FIGS. 8A-8C illustrate a debris prevention architecture that includes telescoping rigid debris exclusion members. A stationary rigid sleeve 134 encases and protects the lower connector(s) 120 from debris. The stinger 210 can include a stationary debris prevention device 240 and/or a stationary debris removal device 250 in the stinger connector port 222, for example, similar to the configuration of FIGS. 5-7. The connector port 122 of the receptacle 110, for example, the rigid sleeve 134, can also include or house a debris prevention device 140 and/or a debris removal device 150.

As shown in FIG. 8B, in use, as the upper completion 200 is lowered into the well, the rigid sleeve 134 stabs into the connector port 222 of the stinger 210. The rigid sleeve 134 punctures the debris protector or prevention device 240 on the stinger 210. The debris removal device 250 on the stinger 210 wipes the outside of the rigid sleeve 134 as the stinger 210 and receptacle 110 move into engagement. The upper connector(s) 220 then puncture the debris prevention device 140 on the rigid sleeve 134. The debris removal device 150 on the rigid sleeve 134 wipes the outside of the upper connector(s) 220 as the stinger 210 and receptacle 110 move into engagement. The two connectors 120, 220 are then fully mated together.

Various types of debris prevention and removal devices can be used in debris prevention architectures, such as those shown in and described with respect to FIG. 5, FIG. 6, FIG. 7, FIG. 8A, FIG. 8B, and FIG. 8C. FIG. 9, FIG. 10, FIG. 11A, FIG. 11B, FIG. 12, and FIGS. 13A-13C illustrate various examples. Debris prevention devices 140, 240 help keep debris out of the connector area, whereas debris removal devices 150, 250 help wipe away or remove debris from the incoming connector. The various designs shown in FIG. 9, FIG. 10, FIG. 11A, FIG. 11B, FIG. 12, and FIG. 13A-13C can be used in various combinations and sub-combinations, in the connector ports 222, 122 of the stinger 210 and/or receptacle 110, respectively, and in conjunction with debris prevention architectures such as those shown in FIGS. 5-8, as well as other debris prevention, mitigation, and/or management architectures for use with various wet-mate connectors.

Figure 9A:
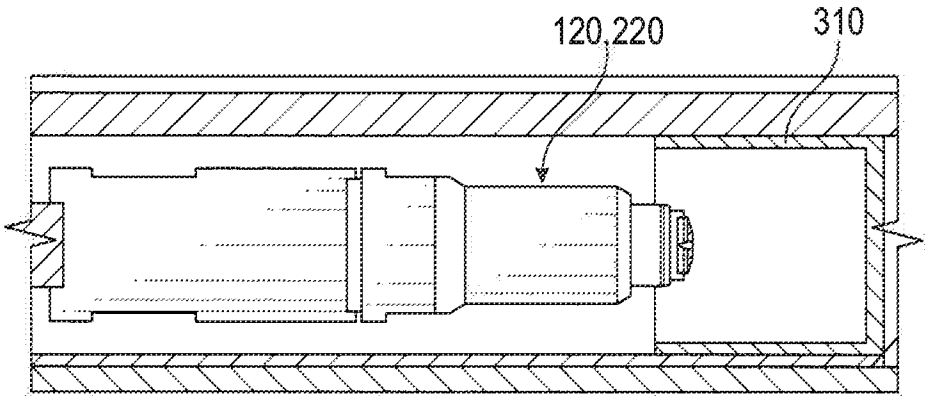
FIGS. 9A, 9B, and 9C illustrate various example debris prevention and/or removal devices.
Figure 9B:
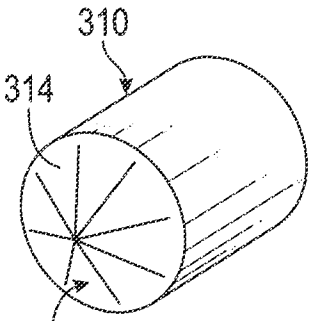
Figure 9C:
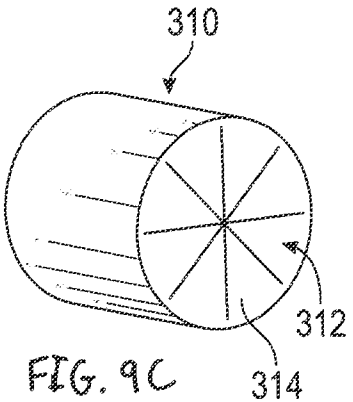

FIGS. 9A-9C illustrate a grommet cover design. An elastomeric cover 310 is installed at, on, or near free ends of the connector port(s) 122, 222, for example as shown in FIG. 9C, to prevent or inhibit debris from entering the area around the connectors. A face 312 of the cover can include or be formed by a plurality of flaps 314, which can be triangular as shown in the illustrated configuration. The flaps 314 can be sized, shaped, and otherwise configured to be overlapping to enhance or maximize debris exclusion and prevention. In some configurations, the face 312 can be cone shaped, for example as shown in FIG. 9B, to help prevent or inhibit debris from settling on the face 312. In use, as the opposite connector(s) (in other words, the upper completion 200 or stinger 210 connector(s) 220 when referring to a grommet 310 on the receptacle 110 and vice versa) penetrates the grommet cover 310, the flaps 314 can also act as a wiper. The grommet cover design can therefore act as a debris prevention device 140, 240 and/or a debris removal device 150, 250. The grommet cover 310 advantageously allows for repeated mating and unmating of the connectors while retaining its debris protection and/or removal capabilities.

Figure 10:
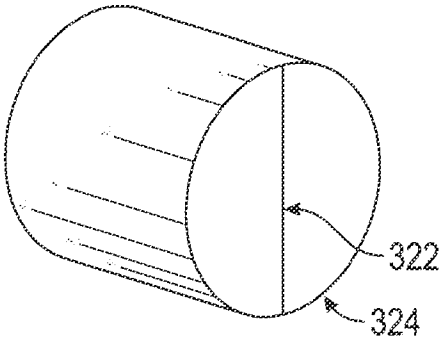
FIG. 10 illustrates multiple example debris prevention and/or removal devices.

FIG. 10 illustrates a split septum cover design. This design is similar to the grommet cover design of FIGS. 9A-9C and can include various features and benefits shown in and described with respect to FIGS. 9A-9C. However, the split septum cover design of FIG. 10 has a single split 322 in the end face 324 (vs a plurality of slits forming the plurality of triangular flaps as in FIGS. 9B-9C). The single split 322 can advantageously increase the radial wiping force compared to the grommet cover design.

Figure 11A:
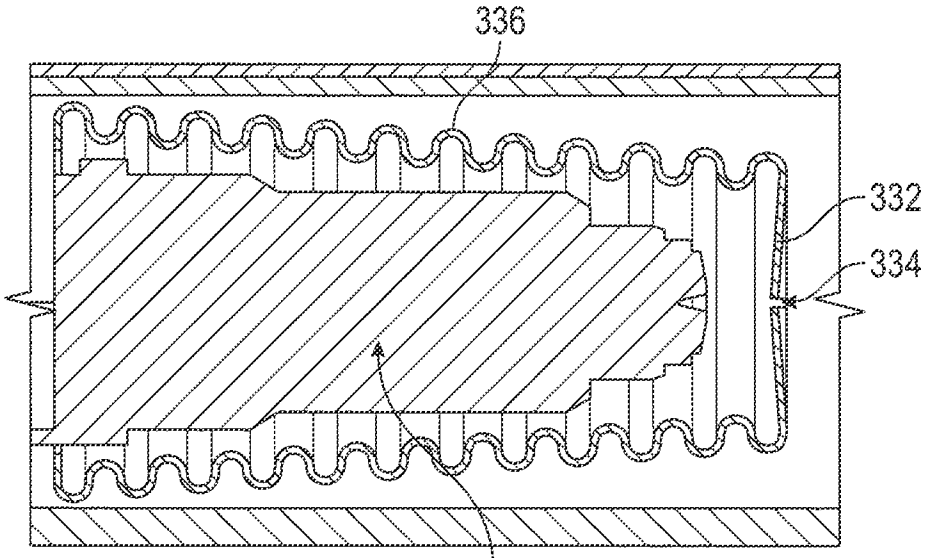
FIGS. 11A and 11B illustrate various other example debris prevention and/or removal devices.
Figure 11B:
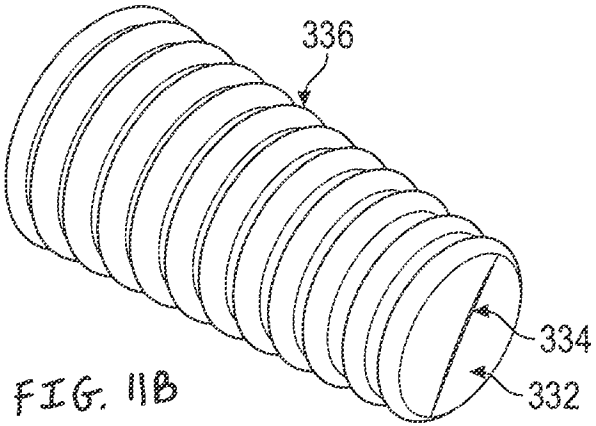

FIGS. 11A-11B illustrates a split septum sleeve design. The end face 332 includes a split 334, similar to the split septum cover design of FIG. 10. However, in the design of FIG. 11A and FIG. 11B, the sleeve 336 (extending from the end face 332) is corrugated, which allows the sleeve 336 to be compressed. In use, when the connectors 120, 220 of the stinger and receptacle mate, the opposite connector(s) (in other words, the upper completion 200 or stinger 210 connector(s) 220 when referring to a split septum sleeve on the receptacle 110 and vice versa) compresses the split septum cover on its associated connector(s). The split 334 in the end face 332 wipes the OD of the associated connector(s) 120, 220 as the sleeve 336 is compressed. When the connector(s) 120, 220 of the stinger 210 and receptacle 110 are unmated, the split septum cover 336 expands back out to fully encase and protect the associated connector(s).

Figure 12:
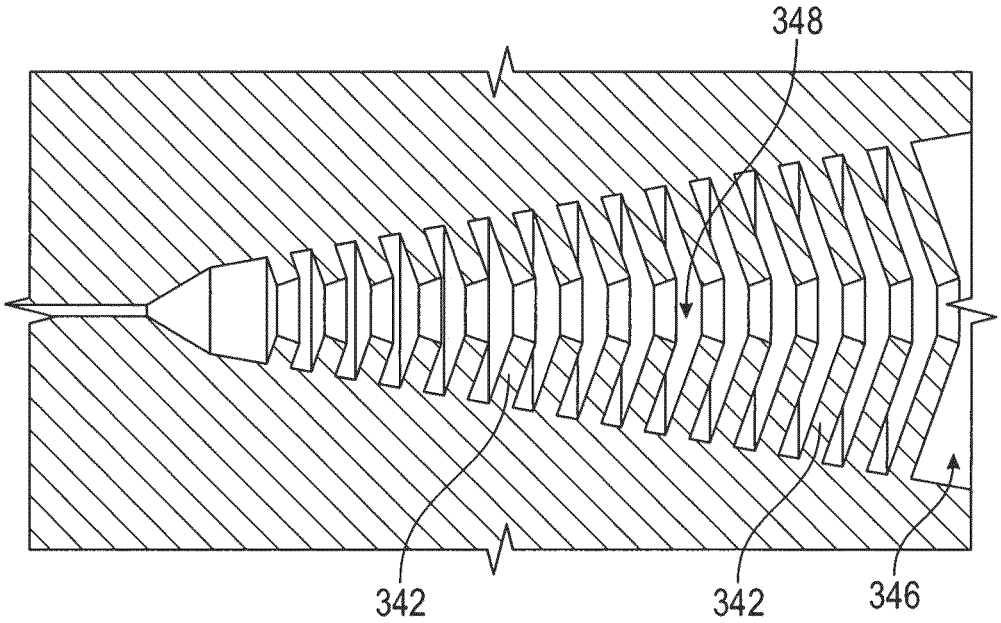
FIG. 12 illustrates several example debris prevention and/or removal devices.

FIG. 12 illustrates a debris wiper design. In some configurations, the debris wiper is elastomeric. As shown, the debris wiper has a central cavity 346 and a plurality of fins 342 projecting into the cavity 346. In the illustrated configuration, the central cavity 346 has a cone shape. The fins 342 can project into the cavity 346 to an extent such that a central passageway 348, which may be generally cylindrical, is defined at least partially through the debris wiper. In use, as a connector 120, 220 enters the debris wiper from the right side of FIG. 12 and moves through the central passageway 348 of the debris wiper, the plurality of fins 342 wipe the connector(s) 120, 220. The plurality of fins 342 can also create a treacherous path for debris to enter the debris wiper, such that the debris wiper can also act as a debris prevention device.

Figure 13B:
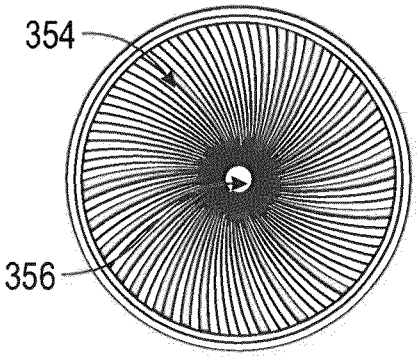
FIGS. 13A, 13B, and 13C illustrates various example debris prevention and/or removal devices.
Figure 13C:
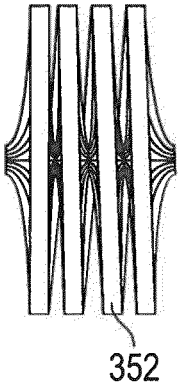
Figure 13A:
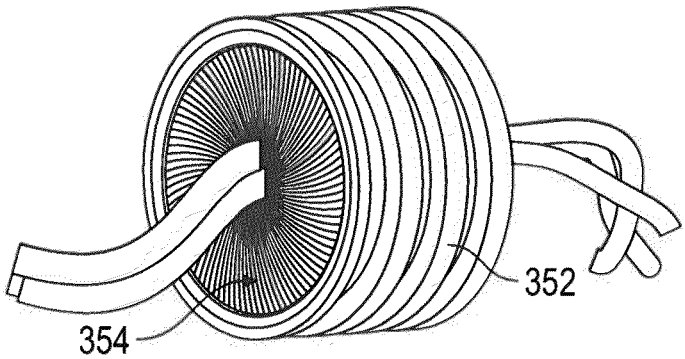

FIGS. 13A-13C illustrates a coiled brush design. As shown, an outer circumference, band 352, or border of the coiled brush can have a generally coiled shape or form. A plurality of bristles 354 project inwardly from the outer band 352. The bristles 354 can form or define a central longitudinal passageway 356 through the coiled brush. As the connector(s) 120, 220 extend through the central longitudinal passageway 356 during engagement of the stinger 210 and receptacle 110 and their associated connector(s) 220, 120, the bristles 354 wipe the connector(s) 120, 220. The bristles 354 can also create a treacherous path for entry of debris, such that the coiled brush can also act as a debris prevention device.

FIGS. 14-22 illustrate an example debris prevention architecture including debris prevention and removal devices and features. In the illustrated configuration, the lower completion 100 includes a mechanical protection feature (e.g., a protective shroud) and/or a flushing system. In other configurations, the flushing system is included in the upper completion instead of or in addition to the lower completion.

The lower completion 100 includes a housing, and a receptacle 110 and alignment sleeve 114 pre-installed in the housing during assembly of the lower completion 100 before deployment. The alignment sleeve 114 can have a pointed geometry or shape. The alignment sleeve 114 can include alignment keys 164 that aid in alignment of the upper completion 200, e.g., the stinger 210, and upper completion wetmate connector 220 as the upper completion 200 and upper wetmate connector 220 are moved into engagement with the lower completion 100, e.g., receptacle 110, and the lower completion wetmate connector 120.

Figure 15:
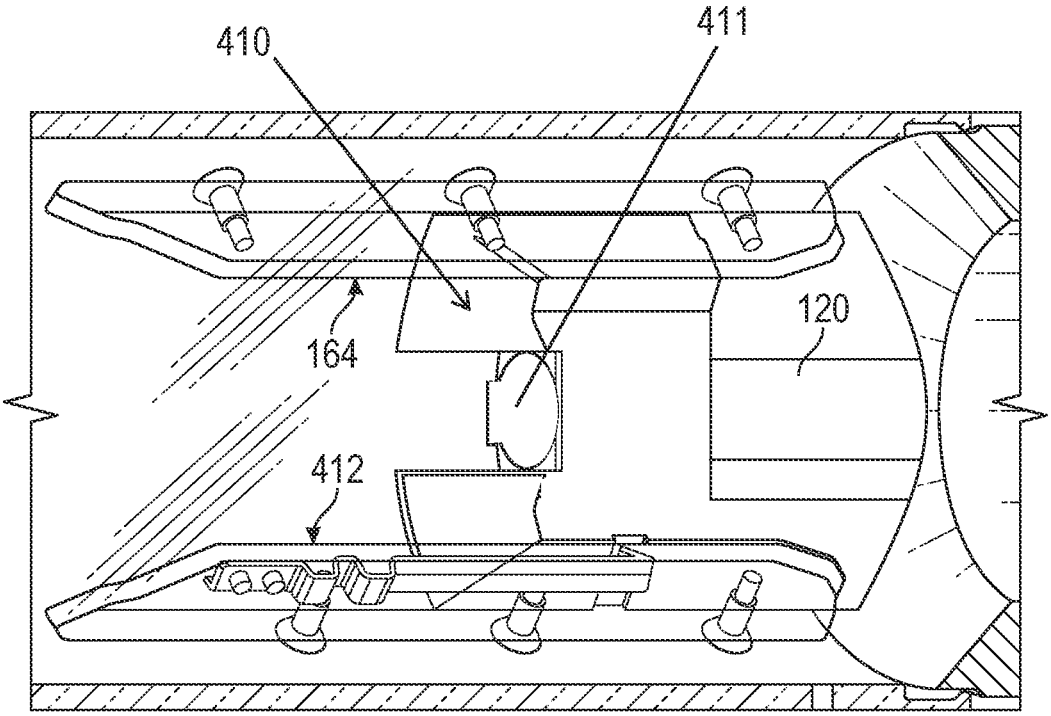
FIG. 15 illustrates a close up view of a portion of the debris prevention architecture and features of FIG. 14.
Figure 16:
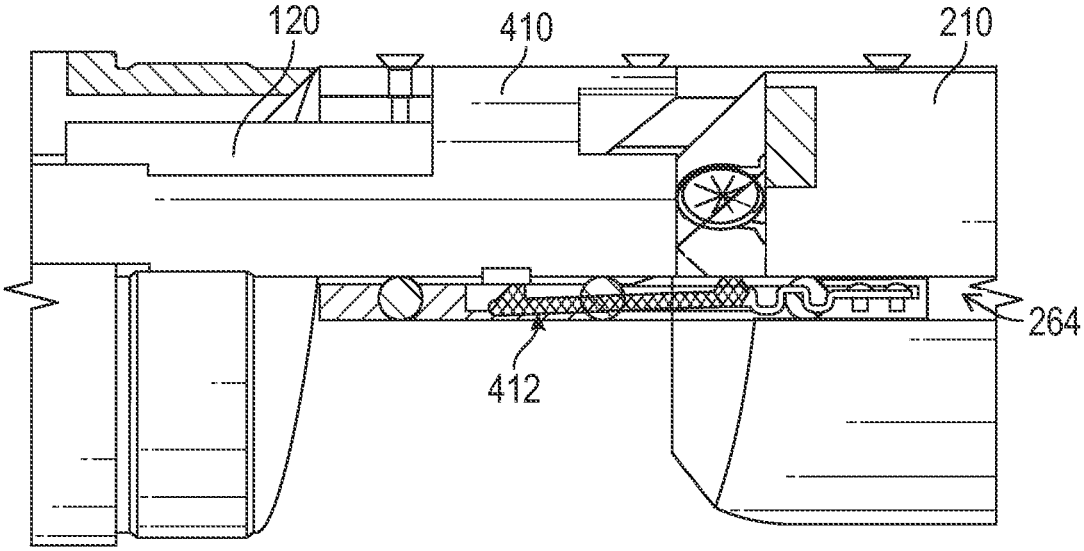
FIG. 16 illustrates disengagement of a spring latch of the debris prevention architecture and features of FIG. 14 during installation of an upper completion.

As shown in FIGS. 15-16, the lower completion 100 also includes a protective cover 410. The connector(s) 120 of the lower completion 100 can be disposed within and/or protected by the protective cover 410 in a closed or default position of the protective cover 410. In other words, when initially deployed, the protective cover 410 covers or extends beyond a leading edge of the connector(s) 120. A debris protection device 140 such as a flapper 411 or pivot door or elastomeric membrane can be incorporated into the sliding block 410 to protect the connector 120 from debris. In other words, a debris protection device 140, for example, a flapper 411 or pivot door or elastomeric membrane, can cover or block a hole or opening through which the connector(s) 120 extend when the protective cover 410 is moved in use to expose the connector(s) 120.

As the lower connector(s) 120 are located within the inner diameter of the receptacle 110, they are exposed to the risk of damage from excessive contact with any equipment run through the inner diameter or from debris that can accumulate around the connector(s). The alignment keys and/or protective cover 410 advantageously provide mechanical protection to the connector(s) 120 of the lower completion 100, for example, protection from accidental damage if any tools or objects, such as intervention tools, are run into the lower completion prior to installation of the upper completion 200.

Figure 14:
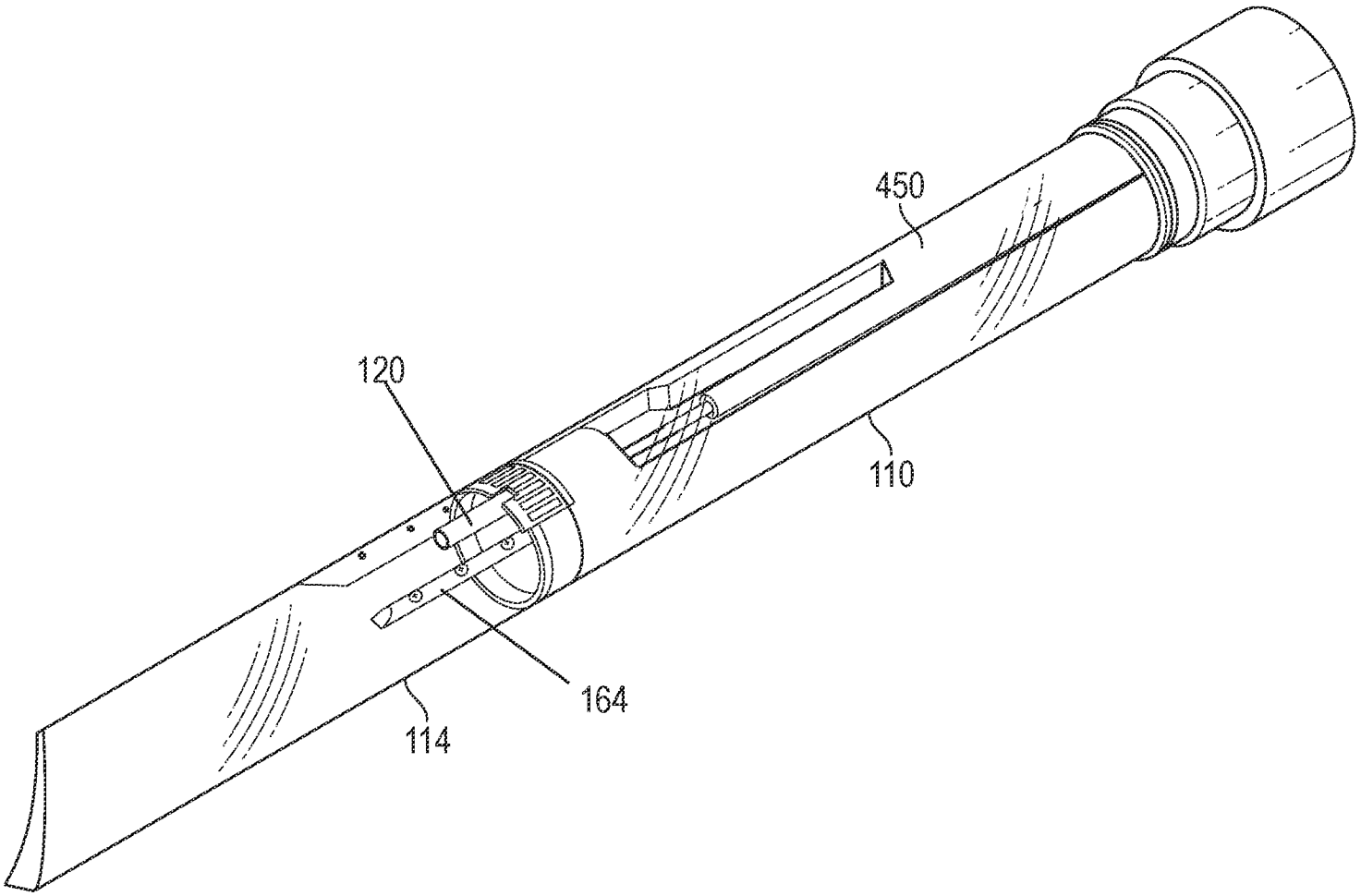
FIG. 14 illustrates an example debris prevention architecture and features in a lower completion.
Figure 18A:
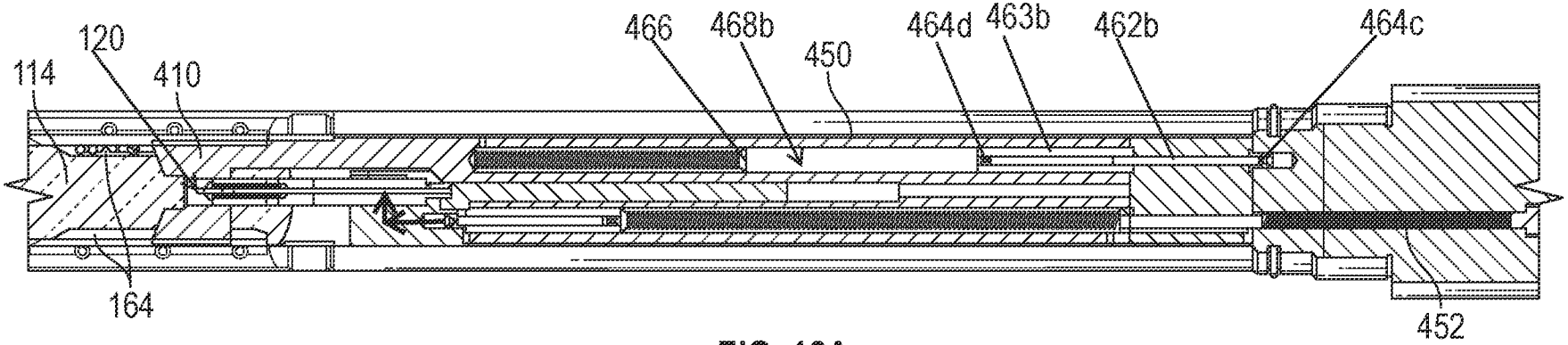
FIGS. 18A-18B illustrates positions of the flushing system of FIG. 17 in use.
Figure 18B:
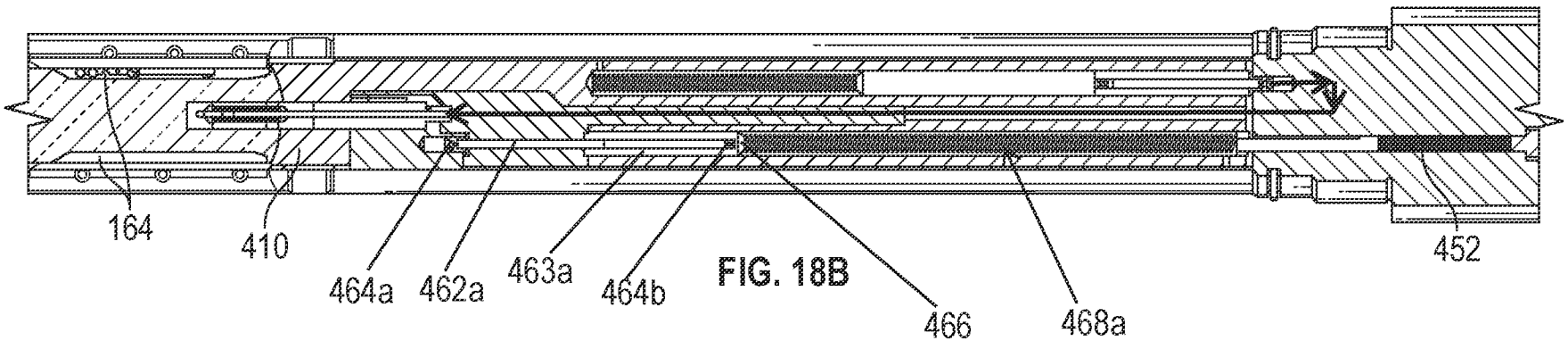

As shown in FIG. 14, the lower completion 100 can also include a sliding body or block 450. The sliding body or block 450 may include or be associated with the flushing system, as described in greater detail herein. In some configurations, the protective cover 410 is part of or connected to the sliding body 450, for example as shown in FIGS. 18A-18B.

A spring latch 412 can be incorporated into one or more of the alignment keys 164, for example as shown in FIG. 15. The spring latch 412 holds the protective cover 410 in the closed position, shown in FIGS. 15 and 18A. During installation of the upper completion 200, as the upper completion, e.g., the stinger 210, approaches the lower completion 100, e.g., the receptacle 110, the lower completion alignment keys 164 enter corresponding slots 264 in the upper completion or stinger 210, thereby disengaging the spring latch 412, as shown in FIG. 16, and releasing the protective cover 410. The protective cover 410 is pushed toward a downhole end of the receptacle 110 by contact with the leading face of the stinger 210 during the last few inches of travel, thereby exposing the lower completion connector(s) 120. In some configurations, the opening to the connector(s) 120 on the protective cover 410 or sliding body 450 is protected by a membrane or pivot door, for example, an elastomer or metallic membrane or pivot door, to provide additional protection from debris ingress.

FIGS. 23, 24, 25A, 25B, 25C, and 26 show additional views and details of the structure and operation of the cover 410. A latch key 420 is coupled to or incorporated into the cover 410. In the illustrated configuration, a first end portion 414 of the spring latch 412 is secured to an alignment key 164. An opposite, second end 416 of the spring latch 412 can be a free end such that the spring latch 412 is cantilevered. The second end 416 can include an engagement profile, such as a hook shape or protruding shoulder as shown. The spring latch 412 can include a protrusion or ramp profile 418 disposed axially between the first 414 and second 416 ends. The spring latch 412 can include a wave portion 420 disposed axially between the first end 414 and the ramp profile 418.

Figure 26:
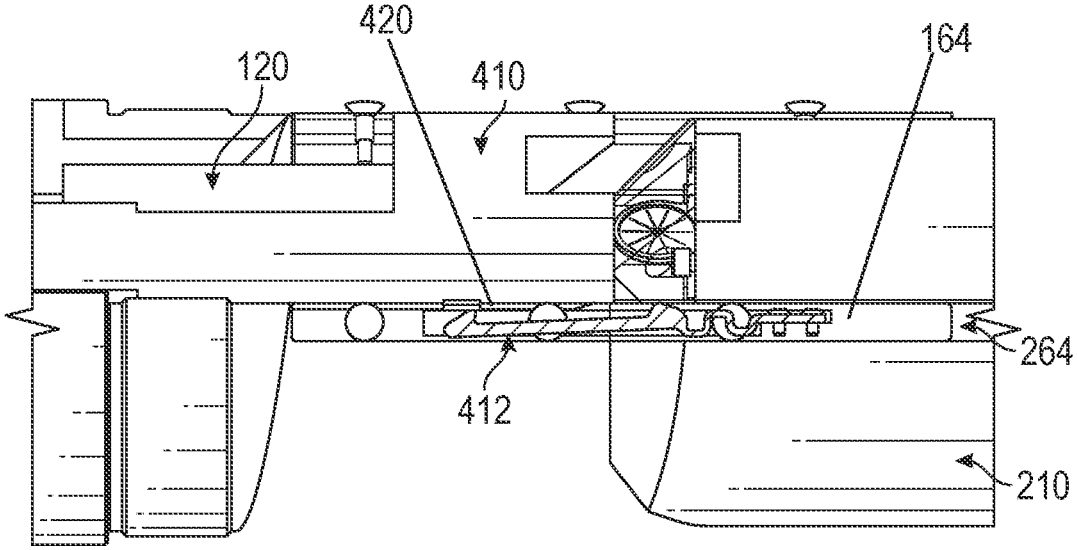
FIG. 26 illustrates disengagement of a spring latch of the debris prevention architecture and features of FIG. 24 during installation of an upper completion.

The spring latch 412 holds the protective cover 410 in the closed position by engaging the latch key 420. In the illustrated configuration, the shoulder of the second end 416 of the spring latch 412 contacts a downhole edge or downhole facing surface of the latch key 420 to prevent or inhibit downhole movement of the cover 410 when the cover 410 is in the closed position protecting the connector(s) 120. During connection of the wetmate system, the stinger 210 stabs into the lower completion 100. As the stinger 210 approaches the receptacle 110, the alignment keys 164 assist and enable fine alignment between the upper 200 and lower 100 completions. As the mating process continues, the lower completion alignment keys 164 enter the corresponding slots 264 in the upper completion or stinger 210. The stinger 210, e.g., a wall of the slot 264, contacts the ramp profile 418 of the spring latch 412. Movement of the stinger 210 along the ramp 418 causes the free end 416 of the spring latch 412 to deflect outward or away from the cover 410, thereby moving the shoulder of the free end 416 out of engagement with the latch key 420, as shown in FIG. 26. The wave portion 420 can bias the spring latch 412 to the closed position, but allow the second end 416 to deflect away from the latch key 420, as shown in FIG. 26, upon engagement by the stinger 210. With the spring latch 412 disengaged from the latch key 420, continued movement of the stinger 210 can slide the cover 410 downhole to expose the lower connector(s) 120.

Figure 17:
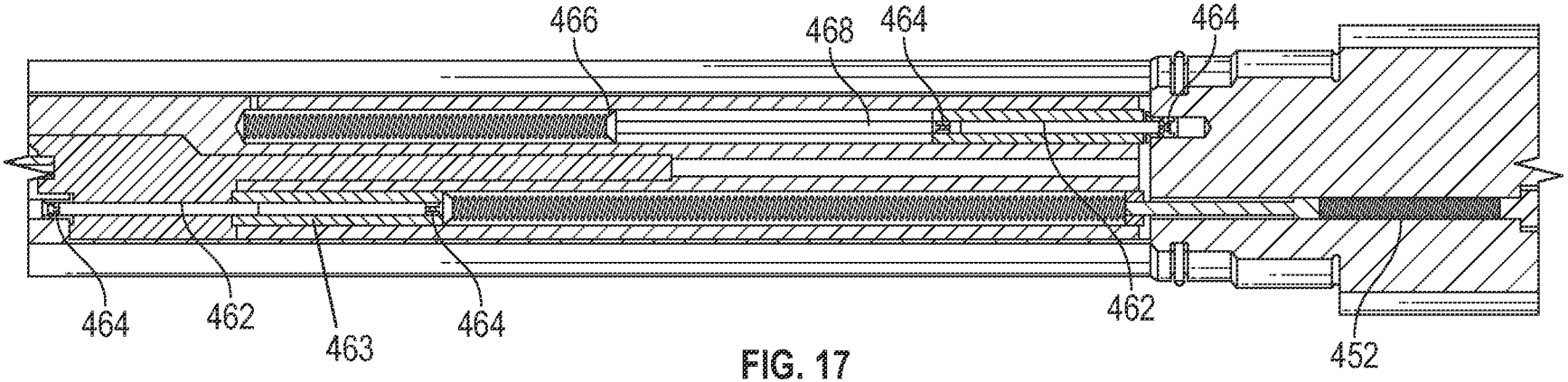
FIG. 17 illustrates a flushing system of the debris prevention architecture and features of FIG. 14.

The sliding body 450 or receptacle 110 includes a return spring 452, for example as shown in FIGS. 17-18B. When the cover 410 and sliding body 450 are pushed downhole by the stinger 210 to expose the connector(s) 120, the return spring 452 is compressed, as shown in FIG. 18B. If the upper completion 200 is uncoupled from the lower completion 100, the return spring 452 returns the sliding body 450, and therefore the protective cover 410, to its original position protecting the connector(s) 120 and re-engages the spring latch 412.

Figure 27:
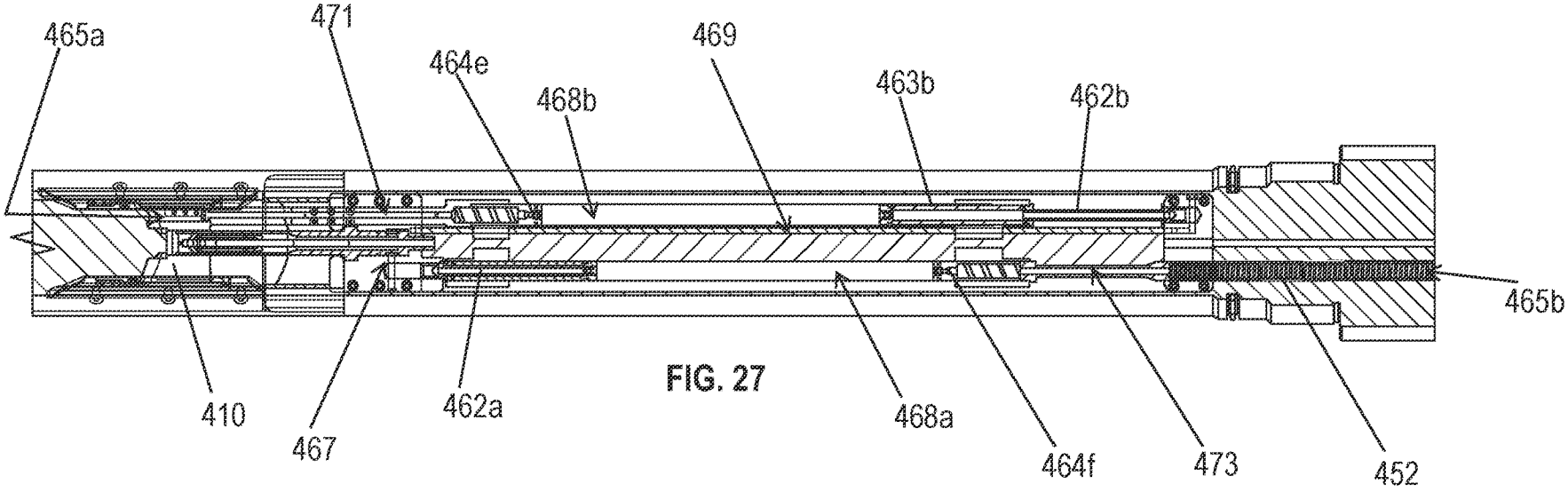
FIG. 27 illustrates a flushing system of the debris prevention architecture and features of FIG. 24.

The sliding motion of the cover 410, and in turn the sliding body or block 450, can also activate the flushing system. Example flushing systems are illustrated in FIGS. 17-18B and FIG. 27. The flushing system can include pre-filled fluid and one or more plungers 462, plunger chambers 463, and/or check valves 464 that allow for the sliding motion to the converted to a pumping action. In some configurations, the flushing system can be entirely or substantially housed within the sliding body 450, for example as shown in FIGS. 17-18B. The sliding body 450 can be a single component, for example as shown in FIGS. 17-18B. Alternatively, the sliding body 450 can include multiple components operably coupled to each other and the cover 410 such that sliding movement of the cover 410 is translated to or causes sliding movement of select components of the flushing system, as described herein, for example as shown in FIG. 27.

In the configuration illustrated in FIGS. 17-18B, the flushing system includes two plungers 462 fixed to the receptacle 110 body, and the sliding body 450. The flushing system also includes spring-loaded refill pistons 466 and check valves 464, which can be disposed internal to the sliding body 450. The flushing system of the configuration of FIG. 27 functions substantially similarly to the configuration of FIGS. 17-18B. However, whereas FIGS. 17-18B show a single piece sliding body 450 housing many components of the flushing system, the flushing system of FIG. 27 includes multiple separate components operably coupled together.

The sliding motion causes displacement of a fixed amount of fluid around and/or through the connector, for example, during the final few inches of travel prior to mating of the upper and lower connectors. As the sliding body 450 is moved axially (with respect to the receptacle cylindrical axis) in either direction, the plungers 462 displace a set volume of fluid. The fluid can flush the connector(s) 120 on the coupling stroke and/or refill the connector(s), e.g., an area surrounding the connector 120, for example, in connector port 122, with clean fluid on the decoupling stroke. This fluid flow advantageously provides a debris flushing action to clear built-up debris prior to mating of the connectors and prevents contaminated wellbore fluids from entering the connector(s) when decoupling the connector(s). The flushing system can be adapted to be utilized in the upper completion as well, where the mating motion of the stinger can activate the flushing system.

On the retracting and extending strokes (of the cover 410 and/or sliding body 450, e.g., relative to the receptacle 110 when included in the lower completion 100) clean fluid is pumped from the plunger system to exit within/around the connectors. In other words, during both mating of the upper and lower connector(s) (which may cause retraction of the cover 410 and/or sliding block 450 to expose the underlying connector(s)) and demating or decoupling of the upper and lower connector(s) (which may cause extension of the cover 410 and/or sliding block 450 or a return of the cover 410 to its default position shielding the connector(s)), the flushing system can flush the connector(s) with clean fluid, for example, from a refill chamber 468. The check valves 464 allow for the clean fluid to refill the plunger cavity from a spring-loaded refill chamber 468 without the clean fluid simply returning to the refill chamber.

In the configurations illustrated in FIGS. 17-18B and 27, the flushing system includes a forward plunger 462*a* and a rear plunger 462*b*, the forward plunger 462*a* being disposed axially closer to the cover 410. A forward end (where forward indicates a direction toward the cover 410 and connector 120) of the forward plunger 462*a* is anchored to receptacle 110 body and includes a check valve 464*a*. A forward plunger chamber 463*a* is coupled to the sliding body 450 and axially movable relative to the forward plunger 462*a* such that the forward plunger 462*a* relatively moves into and out of the forward plunger chamber 463*a*. A rear end of the forward plunger chamber 463*a* includes a check valve 464*b*. A rear end of the rear plunger 462*b* is anchored to the receptacle 110 body and includes check valve 464*c*. A rear plunger chamber 463*b* is coupled to the sliding body 450 and axially movable relative to the rear plunger 462*b* such that the rear plunger 462*b* relatively moves into and out of the rear plunger chamber 463*b*. A forward end of the rear plunger chamber 463*b* includes a check valve 464*d*.

A fluid flow path extends through the forward plunger chamber 463*a* and forward plunger 462*a*, and a fluid flow path extends through the rear plunger chamber 463*b* and rear plunger 462*b*. A forward refill chamber 468*a* is in selective fluid communication with the forward plunger chamber 463*a* via the check valve of the forward plunger chamber 463*a*. A rear refill chamber 468*b* is in selective fluid communication with the rear plunger chamber 463*b* via the check valve of the rear plunger chamber 463*b*. Each of the refill chambers 468*a*, 468*b* includes a spring loaded refill piston 466.

FIG. 18A illustrates the flow path of the cleaning fluid during disengagement of the connectors, or during the extending stroke of the body 450. Movement of the body 450 forward causes the forward plunger chamber 463*a* to move forward relative to the forward plunger 462*a* such that the forward plunger 462*a* relatively moves into the forward plunger chamber 463*a*. As indicated by the arrows, this forces fluid within the forward plunger 462*a* and/or forward plunger chamber 463*a* through the plunger 462*a* check valve 464*a* out of the plunger 462*a*. The fluid then flows along flow path 467 (shown in FIG. 27) to flush the connector 120. In the illustrated configuration, the fluid flows into and through a chamber or flow path through the connector 120 body. The fluid can advantageously fill an area surrounding the connector 120, for example, connector port 122, that would otherwise fill with well fluid when the connectors disengage with clean fluid.

FIG. 18B illustrates the flow path of the cleaning fluid during engagement of the connectors, or during the retracting stroke of the body 450. Movement of the body 450 rearward causes the rear plunger chamber 463*b* to move rearward relative to the rear plunger 462*b* such that the rear plunger 462*b* relatively moves into the rear plunger chamber 463*b*. As indicated by the arrows, this forces fluid within the rear plunger 462*b* and/or rear plunger chamber 463*b* through the rear plunger 462*b* check valve 464*c* out of the plunger 462*b*. The fluid flows through a central flow path 469 (shown in FIG. 27) through the body 450 to then flush the connector 120. In the illustrated configuration, the fluid flows through the central flow path into and through the chamber or flow path through the connector 120 body.

The extending stroke or forward movement of the body 450 also allows for or causes refilling of the rear plunger chamber 463*b* and rear plunger 462*b*. As the body 450 moves forward, the rear plunger chamber 463*b* moves forward, causing relative movement of the rear plunger 462*b* out of the plunger chamber 463*b*. A vacuum thereby created within the plunger chamber 463*b* causes fluid from the rear refill chamber 468*b* to flow through the check valve 464*d* into the plunger chamber 463*b*. The check valve 464*d* allows one way flow of fluid from the refill chamber 468*b* into the plunger chamber 463*b*, preventing the fluid from simply flowing back into the refill chamber 468*b* once the plunger chamber 463*b* is refilled. The check valve 464*c* allows one way flow of fluid out of the plunger 462*b* into the flow path to the connector, preventing fluid in the flow path (expelled clean fluid or well fluid including debris) from being drawn back into the plunger 462*b*.

The retracting stroke or rearward movement of the body 450 allows for or causes refilling of the forward plunger chamber 463*a* and forward plunger 462*a*. As the body 450 moves rearward, the forward plunger chamber 463*a* moves rearward, causing relative movement of the forward plunger 462*a* out of the plunger chamber 463*a*. A vacuum thereby created within the plunger chamber 463*a* causes fluid from the forward refill chamber 468*a* to flow through the check valve 464*b* into the plunger chamber 463*a*. The check valve 464*b* allows one way flow of fluid from the refill chamber 468*a* into the plunger chamber 463*a*, preventing the fluid from simply flowing back into the refill chamber 468*a* once the plunger chamber 463*a* is refilled. The check valve 464*a* allows one way flow of fluid out of the plunger 462*a* into the flow path to the connector, preventing fluid in the flow path (expelled clean fluid or well fluid including debris) from being drawn back into the plunger 462*a*.

As shown in FIG. 27, the flushing system can include a filling port 465*a*. In the illustrated configuration, the filling port 465*a* extends axially through the cover 410. During manufacturing, the clean fluid can be introduced via the filling port 465*a*. The clean fluid flows along a filling flow path to one of both of the refill chambers 468. In some configurations, the filling port 465*a* in the cover 410 allows for filling of the rear refill chamber 468*b*. For example, the clean fluid can flow along a flow path 471 and through the spring of the spring loaded refill piston 466 into the rear refill chamber 468*b*. A check valve 464*e*, for example disposed in or on the rear refill piston 466, prevents fluid in the refill chamber 468*b* from flowing back through the flow path 471 and filling port 465*a*. In some configurations, a filling port 465*b* extends through the return spring 452. Filling fluid can flow along a flow path 473 and through the spring of the spring loaded refill piston 466 to the forward refill chamber 468*a*. A check valve 464*f*, for example disposed in or on the forward refill piston 466, prevents fluid in the refill chamber 468*a* from flowing back through the flow path 473 and filling port 465*b*. In some configurations, the flushing system is pressure balanced. For example, hydrostatic pressure on the connector end of the clean fluid flow path can be balanced by the hydrostatic pressure on the filling port 465*a* end of the clean fluid flow path.

In some configurations, the refill chamber(s) 468 contain sufficient fluid to allow for multiple mating and/or demating cycles. In some configurations, a check valve 464 (e.g., 464*e*) in the refill chamber piston 466 and fine mesh screen can allow for filtered wellbore fluid to enter the system once the reservoir of clean fluid has been depleted after multiple coupling and decoupling cycles. Such a configuration allows filtered wellbore fluid to be used and pumped as the flushing fluid after depleting the reserve of clean fluid until the screen becomes clogged with filtered particles.

Figure 19B:
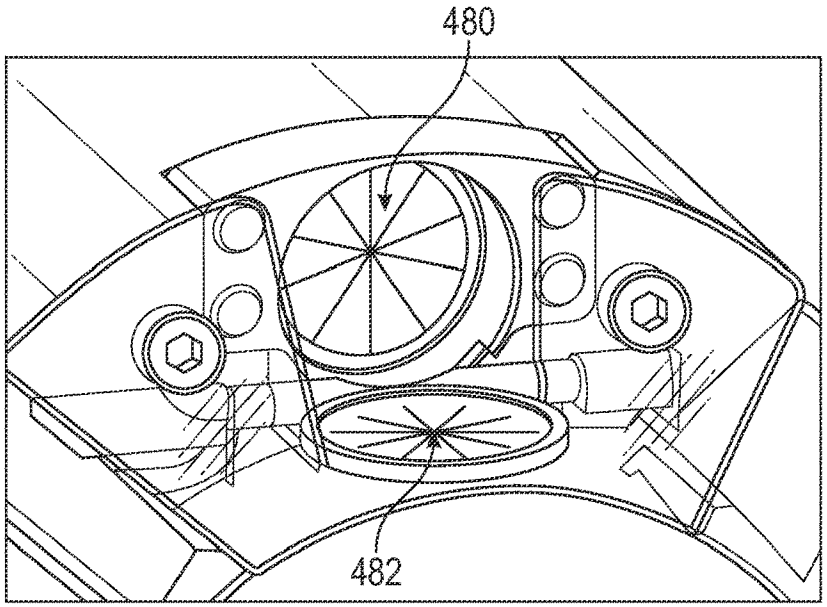
FIGS. 19A-19B illustrates a debris exclusion door of an upper completion in closed and open positions.
Figure 19A:
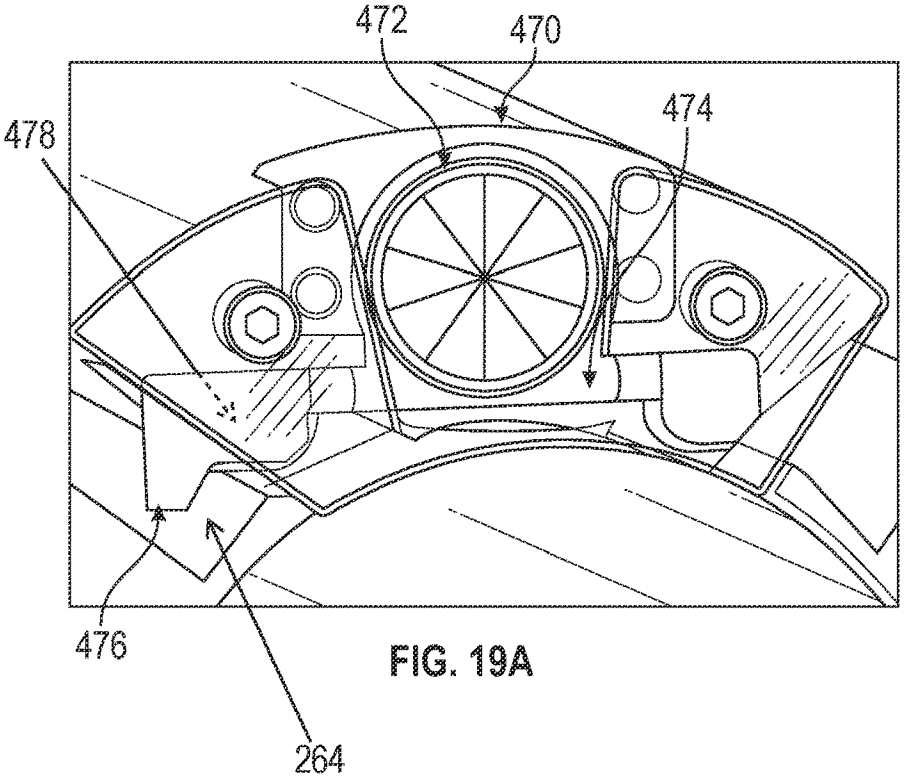
Figure 20:
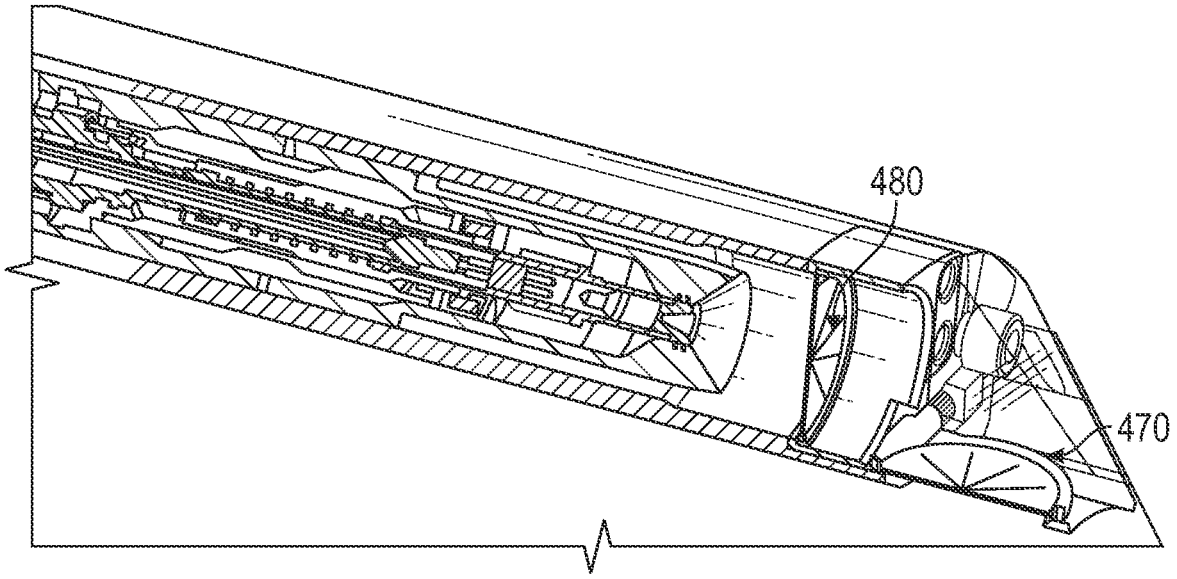
FIG. 20 illustrates an example debris prevention architecture and features in an upper completion, including the debris exclusion door of FIGS. 19A-19B.

The upper completion 200, e.g., the stinger 210, can include a protective debris exclusion element in the form of a spring-loaded debris door 470, for example as shown in FIG. 19A. In some configurations, the stinger 210 includes a second protective debris exclusion element in the form of a membrane 480 (e.g., an elastomeric or metallic membrane), as shown. The spring-loaded debris door 470 is normally closed by a spring return system and protects the connector(s) 220 of the upper completion 200, which may be disposed within or behind the debris door 470. The membrane 480 is disposed behind the debris door 470 and serves as a second protective element. During deployment, interaction with the alignment keys 164 of the lower completion 100 moves the debris door 470 to an open position, shown in FIG. 19B, thereby exposing a cavity 222 in which the upper completion connector(s) 220 are disposed.

The debris door 470 can be pivotally coupled to the upper completion 200, e.g., the stinger 210. As shown in FIG. 19A, the debris door 470 can include a center cover portion 472 attached to a support bar 474 extending radially along a bottom of the center cover portion 472. The center cover portion 472 covers an end of the stinger port 222 in a closed position. The support bar 474 is pivotally coupled to the stinger 210. A projection 476 can project downward from the support bar 474 (or in a direction opposite to the direction in which the center cover portion 472 extends from the support bar 474) at one or both ends of the support bar 474. The projections 476 project or extend into the alignment key receiving slots 264 of the stinger 210. In some configurations, the debris door 470 does not include a projection 476 on the side of the support bar 474 that would cause a projection 476 to extend into the alignment key receiving slot 264 that receives the alignment key including the spring latch 412. This avoids possible interference of a projection 476 with the spring latch 412.

Figure 22:
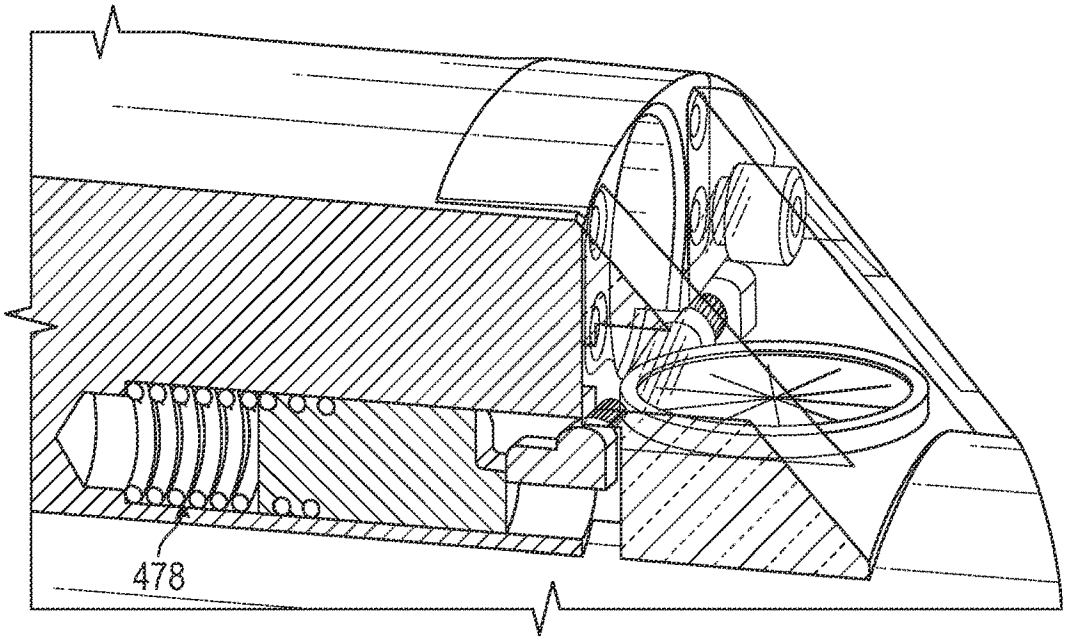
FIG. 22 shows a return spring of the debris exclusion door of FIGS. 19A-19B.
Figure 23:
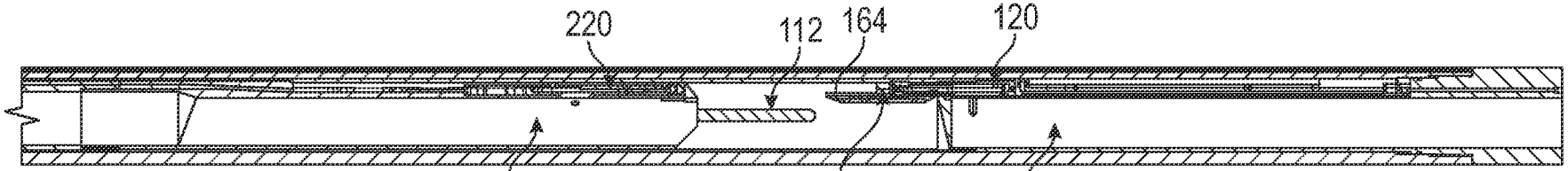
FIG. 23 illustrates an example downhole wetmate system.
Figure 24:
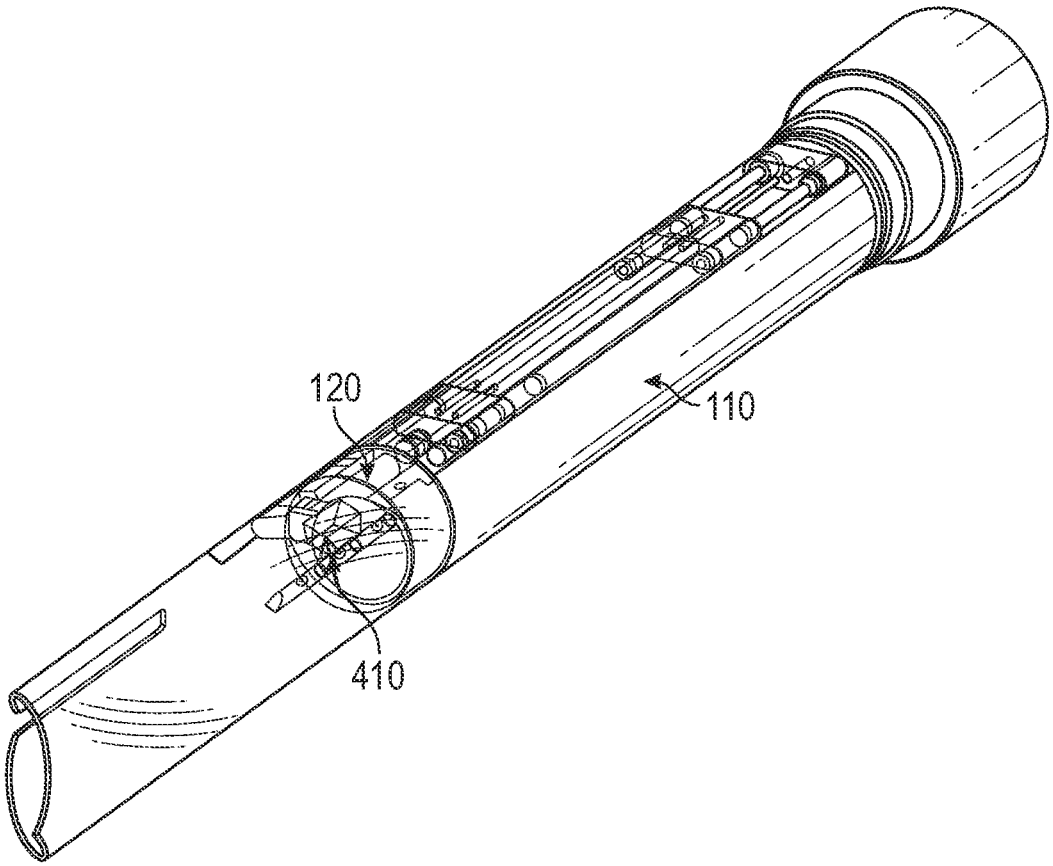
FIG. 24 illustrates an example debris prevention architecture and features in a lower completion.
Figure 25A:
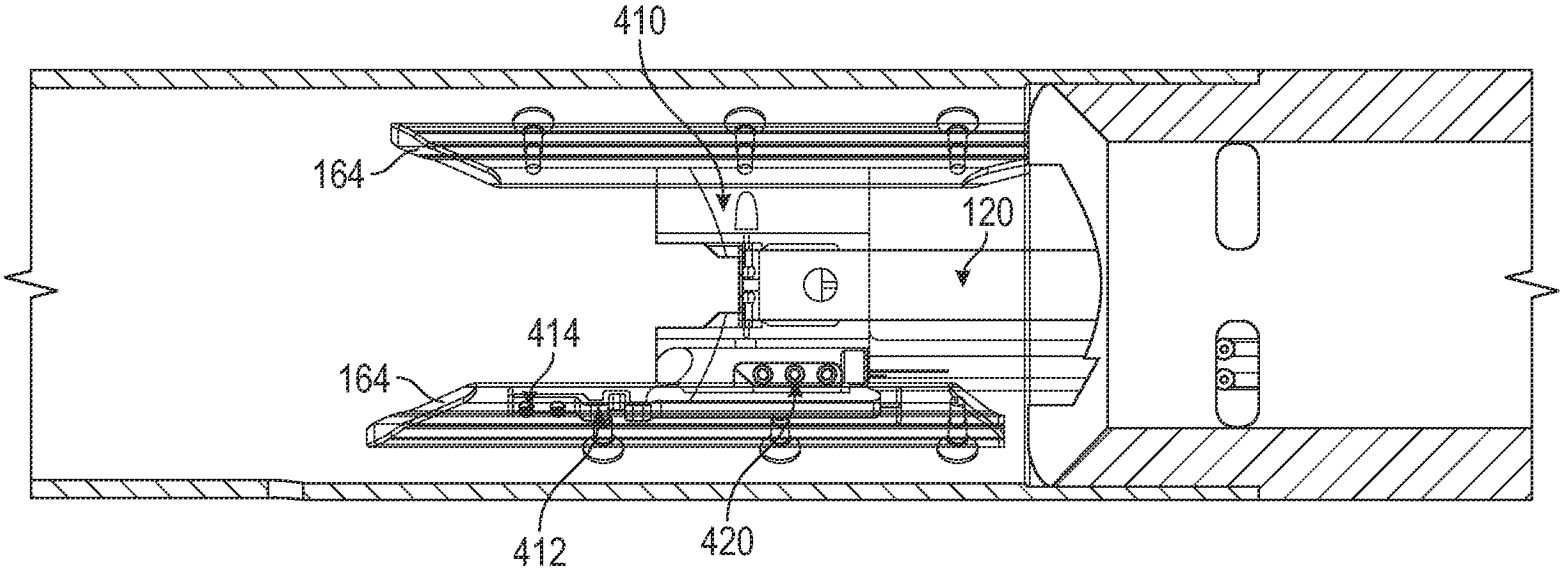
FIGS. 25A, 25B, 25C illustrate various views of portions of the debris prevention architecture of FIG. 24.
Figure 25B:
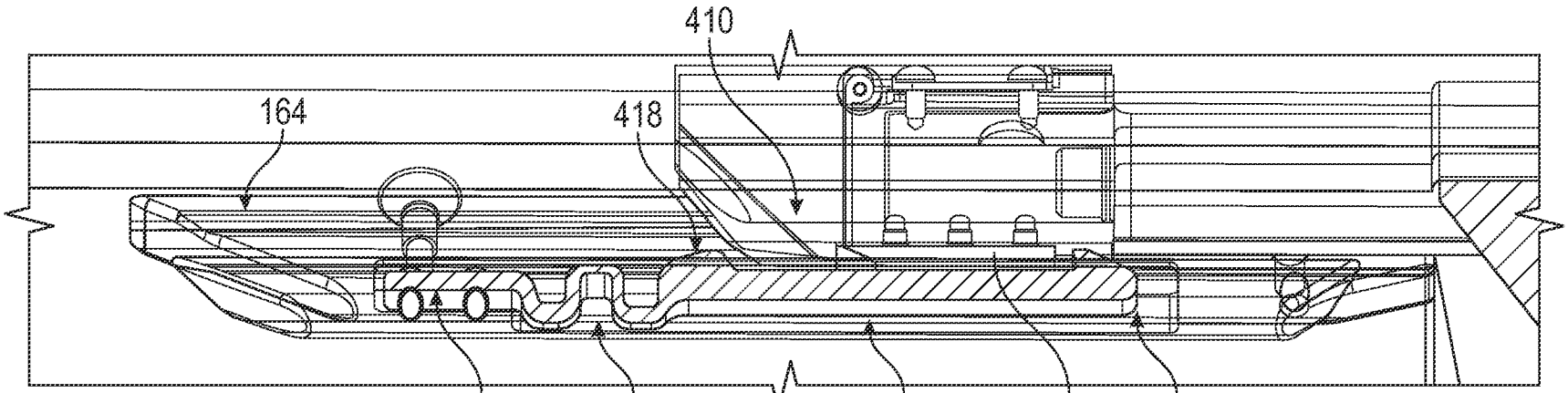
Figure 25C:
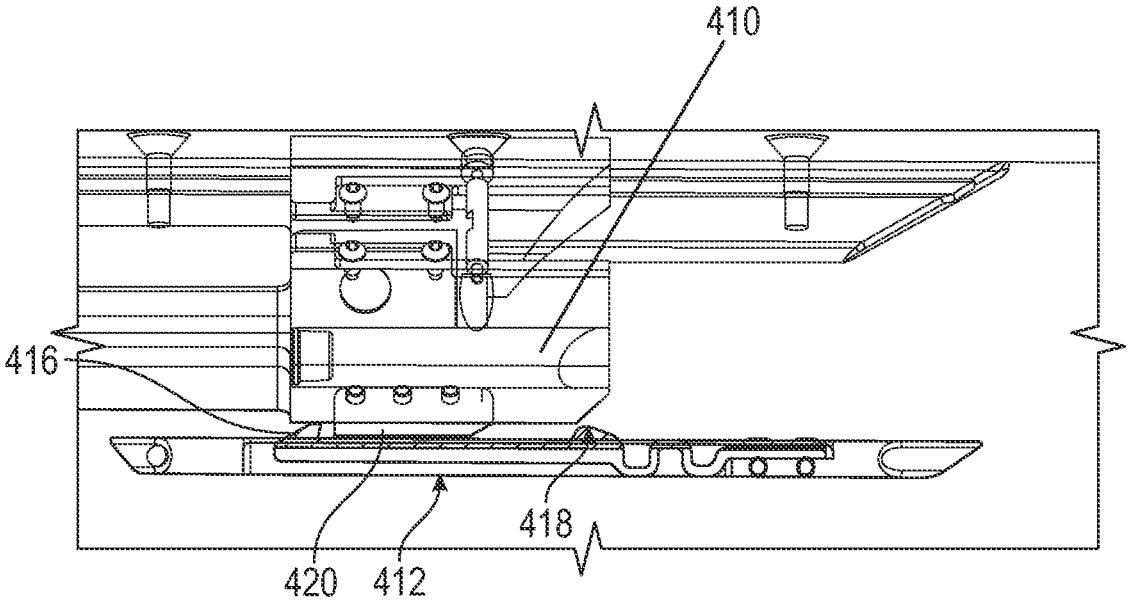

As the upper completion 200 is moved into engagement with the lower completion 100, an alignment key 164 contacts the projection 476 (or in the case or two alignment keys 164 and two projections, 476, each of the alignment keys 164 contacts one of the projections 476) and continues moving past the support bar 474, causing the support bar 474 and center cover portion 472 to pivot open, as shown in FIG. 19B and in FIG. 22. As shown in FIG. 22, the debris door 470 is biased closed by one or more return springs 478. The alignment key(s) 164 compress the return spring(s) 478 to pivot the debris door 470 open. If the upper completion 200 is decoupled, the removal of the alignment key(s) 164 allows the return spring(s) 478 to expand, thereby pushing the projection(s) 476 of the debris door 470 to pivot the debris door 470 back to the closed position.

As indicated in FIG. 19A, the return spring 478 can be disposed in a recess positioned adjacent (e.g., circumferentially adjacent about the stinger 210) the alignment key receiving slot 264. As the alignment key 164 moves within the slot 264 and pivots the projection 476, the projection 476 pivots out of the slot 264 and into the return spring recess. Presence of the alignment key 164 in the slot 264 holds the projection 476 in the return spring recess and therefore maintains the return spring 478 in the compressed state. If the upper completion 200 is decoupled, removal of the alignment key 164 removes the force holding the projection 476 in the return spring recess, and the return spring 478 is able to expand and pivot the projection 476 out of the return spring recess and into the slot 264.

Figure 21:
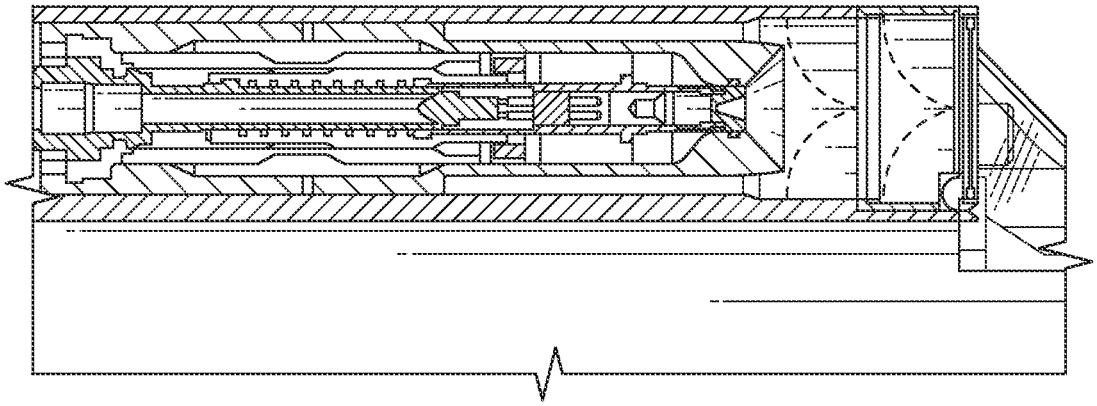
FIG. 21 shows the debris prevention architecture and features of FIG. 20, showing clearances for membrane elements.

As the upper completion 200 continues to move into engagement with the lower completion 100 after the debris door 470 is open, the lower completion connector(s) 120 rupture the membrane 480, enter the upper completion connector cavity 222, and couple with the upper completion connector(s) 220. In some configurations, the debris door 470 includes a protective membrane 482 as a backup or failsafe. In such configurations, if the debris door 470 does not properly actuate and pivot in use, the lower completion connector(s) 120 can pass through the membrane 482 of the debris door 470. An enclosed volume of fluid around the connector 120 behind the debris door 470 can help limit flow or dynamic forces against the failsafe membrane 482. As shown in FIG. 21, sufficient clearance is provided in the upper completion 200 for the membrane 480 and/or failsafe membrane 482 (e.g., wedge-shaped petals of the membrane 480 and/or failsafe membrane 482) to swing clear of all contact areas without being pinched as the connectors mate, which could lead to pieces becoming detached and trapped.

The debris prevention architecture and features of FIGS. 14-22 advantageously allow for multiple connect-disconnect (or mate/unmate) cycles of the connectors. After the upper completion and lower completion connectors have been successfully mated, the protective debris prevention elements can be reset to a protective state if the upper completion 200 is pulled out of hole and the connectors are unmated. The spring returns of the upper completion debris door 470 and the lower completion sliding block 450 return the respective protective elements to their original protective positions, with the debris door 470 closed and covering the upper completion connector cavity 222 and the sliding block 450 covering the lower completion connector(s) 120.

As described herein, debris can accumulate around wetmate connectors and interfere with proper mating of the upper completion connectors and lower completion connectors. Cleaning systems and operations can be used to circulate fluid through tubing of the upper completion and into an annular area, for example, between the upper and lower completion, to clean the wetmate connectors before mating. However, some downhole completion systems include various seals that may prevent cleaning fluid from traveling on the return path.

Figures 28, 29, 30:
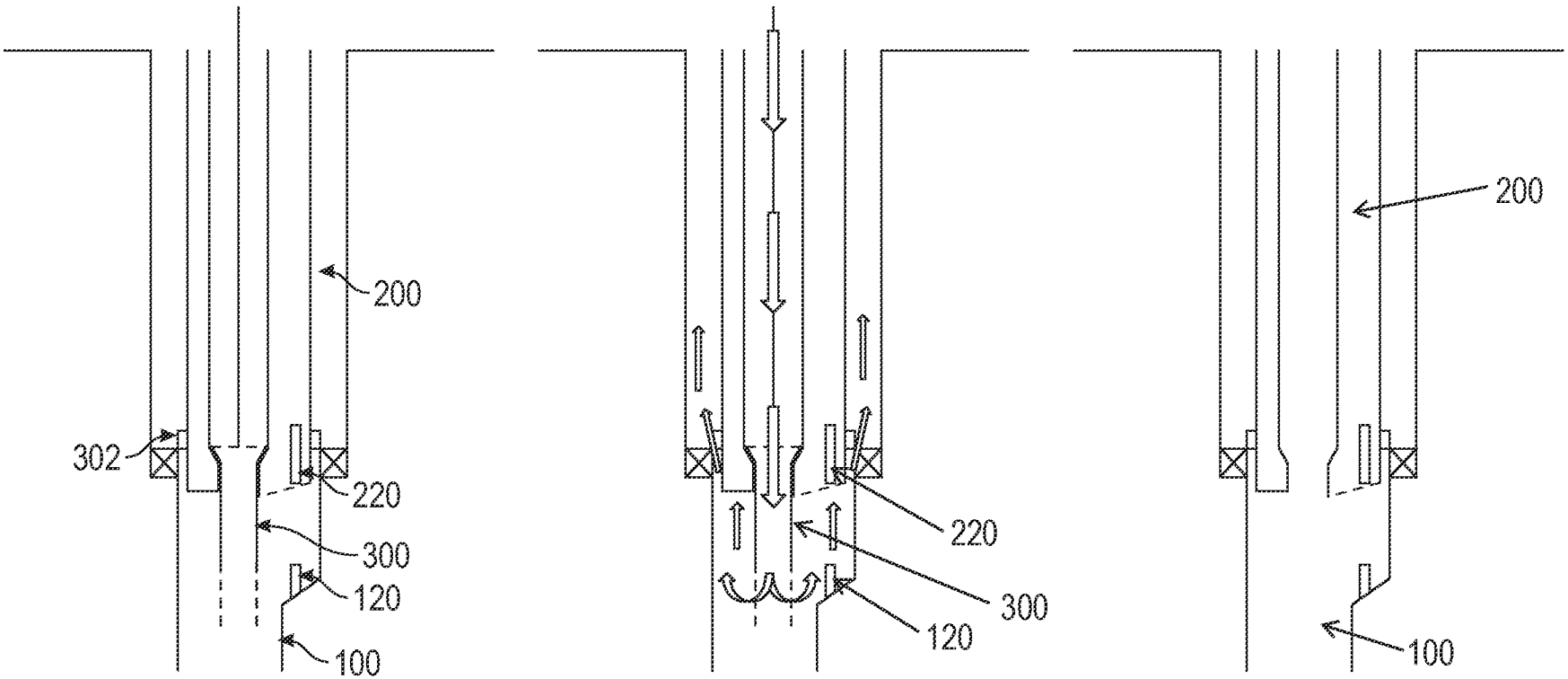
FIG. 28 illustrates an example extendable cleaning sleeve deployed in a two stage completion.
FIG. 29 illustrates a flow path of cleaning fluid through the extendable cleaning sleeve and completion of FIG. 28.
FIG. 30 illustrates the two stage completion of FIG. 28 with the extendable cleaning sleeve removed.

FIGS. 28-30 illustrate an example system and method for cleaning wetmate connectors to disrupt and remove debris accumulated around the connectors. Systems according to the present disclosure can include an extendable cleaning sleeve 300 that advantageously allows for circulation of cleaning fluid around the connectors when seals would otherwise block a typical circulation pathway. The extendable cleaning sleeve 300 can be extended during running in hole or nested in the inner diameter of the upper completion 200 to be extended later during the operation.

As shown in FIG. 28, as the upper completion 200 is run in hole, the upper completion string 200 is stopped before the seals 302 enter the anchored lower completion 100, as the seals 302 entering the lower completion 100 would block the return cleaning fluid path. In this position, the stinger 210, or end of the upper completion 200, is typically around 5-15 ft away from the wetmate connector(s) 120 of the lower completion 100. At this distance, attempting to circulate cleaning fluid normally through the upper completion 200 to clean the lower connector(s) 120 would not be very effective. However, the extendable cleaning sleeve 300 extends past or below the end of the upper completion 200 to come into closer proximity with the lower connector(s) 120. The circulating flow of cleaning fluid can therefore clean settled debris on or around the lower connector(s) 120 immediately before mating with the upper connector(s) 220. In various configurations, the location of the upper completion 200 can be determined by surface indication of the seals engaging, a pip tag, RFID, magnetic sensor, or other suitable means.

In some configurations, the extendable cleaning sleeve 300 is preinstalled on the upper completions 200 before run in hole. The extendable cleaning sleeve 300 can be run in hole (e.g., with the upper completion 200) in its extended state, or nested within the upper completion 200. If the extendable cleaning sleeve 300 is run in hole in a nested state, the extendable cleaning sleeve 300 can be extended via commands or actions at the surface once the upper completion 200 is appropriately positioned for the cleaning operation. Once properly positioned and extended (if needed), circulating fluid, such as cleaning fluid, can be pumped downhole from the surface through the upper completion 200 (e.g., through tubing, such as production tubing, of the upper completion) and through the extendable cleaning sleeve 300 along the flow path indicated by arrows in FIG. 29. As shown, the circulating fluid flows around the connector(s) 120 and/or 220 and past the seals 302 to return to the surface via an annulus between the upper completion 200 and the casing. When the circulating or flushing operation is complete, the extendable cleaning sleeve 300 can be retrieved and removed via a wireline tool, leaving the upper and lower completions in place, as shown in FIG. 30. Wireline retrieval can advantageously allow for reduced conveyance and rig time and reduced footprint on the rig, for example compared to coil tubing or tubing conveyed systems.

In some configurations, the extendable cleaning sleeve 300 can be run in hole, for example, via wirelines, after the upper completion 200 has been deployed to the predetermined cleaning depth. To indicate the wireline-run extendable cleaning sleeve 300 has reached the appropriate depth, the extendable cleaning sleeve 300 and upper completion 200 can include interacting profiles, or other means, such as a pip tag, RFID, or magnetic sensor, can be used.

After the cleaning operation and after the cleaning sleeve 300 has been retrieved and removed from the completion, the wetmate connection can proceed. Mating verification can be accomplished by pip tag, RFID, magnetic sensor, or other suitable means.

Figure 31:
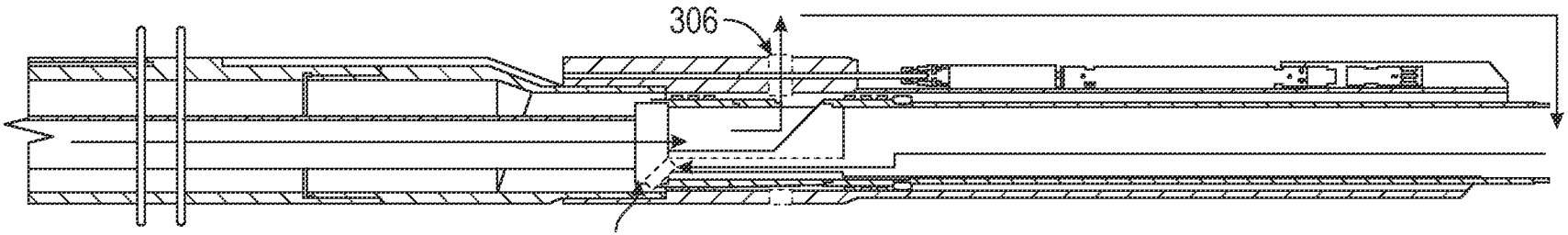
FIG. 31 illustrates a longitudinal cross-sectional view of another example extendable cleaning sleeve.

FIG. 31 shows another embodiment of a cleaning sleeve 300. As described with respect to the embodiment of FIGS. 28-30, the extendable cleaning sleeve 300 of FIG. 31 can be preinstalled with the upper completion 200 or conveyed via wireline. However, the configuration of FIG. 31 has a different circulation pathway for the cleaning fluid. The fluid is pumped down (e.g., toward the right side of FIG. 31) through the tubing of the upper completion 200, exits into the annular area outside the stinger 210 or upper completion 200, continues down to flush the connector(s) 120, then travels a return path up through secondary tubing located at the bottom of the extendable cleaning sleeve 300, and then exits into the annular area surrounding the upper completion 200. As shown, the secondary tubing can extend from a temporary service crossover assembly 304 coupled to the upper completion. The port for fluid in the return path to exit the secondary tubing into the annular space outside the upper completion can be located opposite (e.g., diametrically opposed to) the circulation port 306 for the cleaning fluid to exit the upper completion into the annular space on the downward path to the connector(s).

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A downhole completion system, comprising:

an upper completion stage comprising a stinger and a first communication line connector;

a lower completion stage comprising a receptacle and a second communication line connector, the stinger configured to engage the receptacle and the first communication line connector configured to couple to the second communication line connector; and a debris prevention architecture configured to protect the first and/or second communication line connectors from debris, wherein the debris prevention architecture comprises a flushing system configured to flush at least one of the first communication line connector and the second communication line connector with clean flushing fluid during both a mating operation of the first and second communication line connectors and a demating operation of the first and second communication line connectors; and a first plunger;

a first plunger chamber, the first plunger configured to move relatively into and out of the first plunger chamber;

a second plunger;

a second plunger chamber, the second plunger configured to move relatively into and out of the second plunger chamber;

wherein during a mating operation of the first and second communication line connectors, movement of the first plunger relatively into the first plunger chamber releases a volume of fluid to flush the second communication line connector; and wherein during a demating operation of the first and second communication line connectors, movement of the second plunger relatively into the second plunger chamber releases a volume of fluid to flush the second communication line connector.

2. The downhole completion system of claim 1, wherein the debris prevention architecture comprises a spring-loaded block configured to protect the second communication line connector from debris and damage.

3. The downhole completion system of claim 2, wherein as the stinger is moved into engagement with the receptacle, the stinger is configured to push the spring-loaded block downward to expose the second communication line connector.

4. The downhole completion system of claim 3, wherein the debris prevention architecture comprises a flushing system configured to flush at least one of the first communication line connector and the second communication line connector with clean flushing fluid during both a mating operation of the first and second communication line connectors and a demating operation of the first and second communication line connectors, and wherein the flushing system is activated by sliding movement of the spring-loaded block to expose or cover the second communication line connector.

5. The downhole completion system of claim 3, the lower completion stage comprising one or more alignment keys, one of the alignment keys comprising a spring latch, wherein the spring latch is configured to engage a latch key on the spring-loaded block to hold the spring-loaded block in a position covering the second communication line connector.

6. The downhole completion system of claim 5, wherein as the stinger is moved into engagement with the receptacle, the stinger is configured to deflect the spring latch out of engagement with the latch key to allow the spring-loaded block to move downward and expose the second communication line connector.

7. The downhole completion system of claim 1, the stinger comprising a stinger connector port housing the first communication line connector.

8. The downhole completion system of claim 7, further comprising a debris prevention device and/or a debris removal device disposed in or at an entrance to the stinger connector port.

9. The downhole completion system of claim 1, wherein the flushing system is configured to flush with clean flushing fluid during multiple mating and demating cycles.

10. The downhole completion system of claim 1, wherein during the mating operation, movement of the second plunger relatively out of the second plunger chamber refills the second plunger chamber and second plunger with fluid from a refill chamber, and wherein during the demating operation, movement of the first plunger relatively out of the first plunger chamber refills the first plunger chamber and first plunger.

* * * * *